US010068404B2

(12) United States Patent
Shibata et al.

(10) Patent No.: US 10,068,404 B2
(45) Date of Patent: Sep. 4, 2018

(54) COIN CONVEYING DEVICE

(71) Applicant: FUJI ELECTRIC CO., LTD., Kawasaki-shi, Kanagawa (JP)

(72) Inventors: Yoshito Shibata, Tsu (JP); Takuya Fukuura, Yokkaichi (JP); Masao Nakayama, Yokkaichi (JP); Shimoto Ichihara, Yokkaichi (JP); Kazuhiro Tomita, Yokkaichi (JP); Masashi Nagata, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/783,621

(22) Filed: Oct. 13, 2017

(65) Prior Publication Data

US 2018/0151014 A1 May 31, 2018

(30) Foreign Application Priority Data

Nov. 29, 2016 (JP) ..... 2016-231396
Nov. 29, 2016 (JP) ..... 2016-231541

(51) Int. Cl.

| | |
|---|---|
| ***G07D 1/00*** | (2006.01) |
| ***G07D 1/02*** | (2006.01) |
| ***G07D 3/06*** | (2006.01) |
| ***G07D 3/14*** | (2006.01) |
| ***G07D 3/12*** | (2006.01) |
| *G07D 9/00* | (2006.01) |
| *G07D 5/00* | (2006.01) |

(52) U.S. Cl.
CPC ..... *G07D 1/02* (2013.01); *G07D 3/06* (2013.01); *G07D 3/125* (2013.01); *G07D 3/14* (2013.01); *G07D 5/00* (2013.01); *G07D 9/008* (2013.01)

(58) Field of Classification Search
CPC .. G07D 1/00; G07D 1/02; G07D 3/00; G07D 3/16; G07D 11/0003; G07D 2201/00
See application file for complete search history.

(56) References Cited

U.S. PATENT DOCUMENTS 4,360,034 A * 11/1982 Davila ..... G07D 3/10 221/182
2012/0122385 A1* 5/2012 Watson ..... G07D 3/14 453/56
2015/0371478 A1* 12/2015 Blythin ..... G07D 9/00 453/56

FOREIGN PATENT DOCUMENTS

JP 2011-039773 A 2/2011

* cited by examiner

*Primary Examiner* — Mark J Beauchaine
(74) *Attorney, Agent, or Firm* — Manabu Kanesaka

(57) ABSTRACT

A coin conveying device for a coin processing apparatus configured to store an input coin according to denomination, and dispense a coin stored therein in accordance with a payout instruction is provided. The coin conveying device includes: a rail portion configured to form a conveyance path to convey a coin; a conveying portion including holders connected endlessly, each holder being configured to hold one coin, the conveying portion being configured to convey the input coin from below to above by displacing the conveying portion in one direction along the rail portion; and a controller configured to, when the input coin is put in the conveying portion, displace the conveying portion in a reverse direction that is opposite to the one direction for a predetermined time, and displace the conveying portion in the one direction after the predetermined time has elapsed.

6 Claims, 33 Drawing Sheets

COIN CONVEYING DEVICE

CROSS-REFERENCE TO RELATED APPLICATION(S)

The present application claims priority to and incorporates by reference the entire contents of Japanese Patent Application No. 2016-231396 filed in Japan on Nov. 29, 2016 and Japanese Patent Application No. 2016-231541 filed in Japan on Nov. 29, 2016.

BACKGROUND

1. Technical Field

The disclosure relates to a coin conveying device.

2. Related Art

In the related art, a coin processing apparatus that is applied as, for example, a change machine examines the genuineness and the denominations of coins input through a coin slot, and then automatically takes in coins identified as genuine to store in coin storages provided per denomination. Moreover, according to a change output request from an external device or the like, the coin processing apparatus outputs coins of a requested amount as change from coins stored in the coin storages (for example, Japanese Laid-open Patent Publication No. 2011-39773).

SUMMARY

In the coin processing apparatus described above, coins are conveyed with a structure in which multiple belts each of which is arranged endlessly by being hooked to a pair of rollers under tension are arranged such that a most upstream portion of a belt on a downstream side is positioned under a most downstream portion of a belt on an upstream side. As each of the belts needs certain conveyance length, it has been difficult to downsize the entire apparatus.

It is desirable to provide, in view of the above situation, a coin conveying device that enables to downsize a coin processing apparatus.

It is an object of the disclosure to at least partially solve the problems in the conventional technology.

In some embodiments, a coin conveying device for a coin processing apparatus configured to store an input coin according to denomination, and dispense a coin stored therein in accordance with a payout instruction is provided. The coin conveying device includes: a rail portion configured to form a conveyance path to convey a coin; a conveying portion including holders connected endlessly, each holder being configured to hold one coin, the conveying portion being configured to convey the input coin from below to above by displacing the conveying portion in one direction along the rail portion; and a controller configured to, when the input coin is put in the conveying portion, displace the conveying portion in a reverse direction that is opposite to the one direction for a predetermined time, and displace the conveying portion in the one direction after the predetermined time has elapsed.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

An exemplary embodiment of a coin conveying device according to the disclosure is explained in detail below referring to the accompanying drawings.

Figure 1:
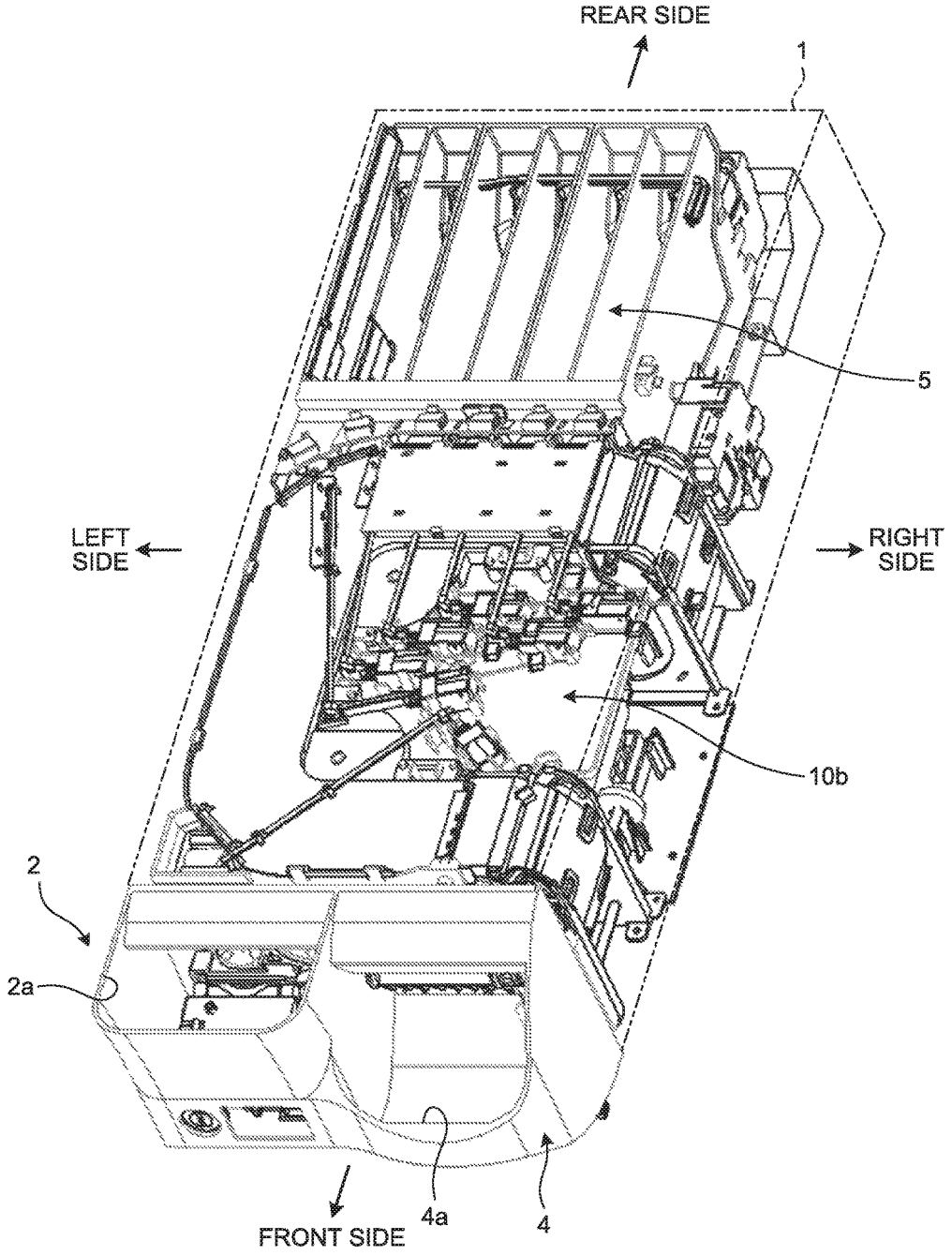
FIG. 1 is a perspective view showing an internal configuration of a coin processing apparatus to which a coin conveying device of an embodiment of the disclosure is applied.
Figure 2:
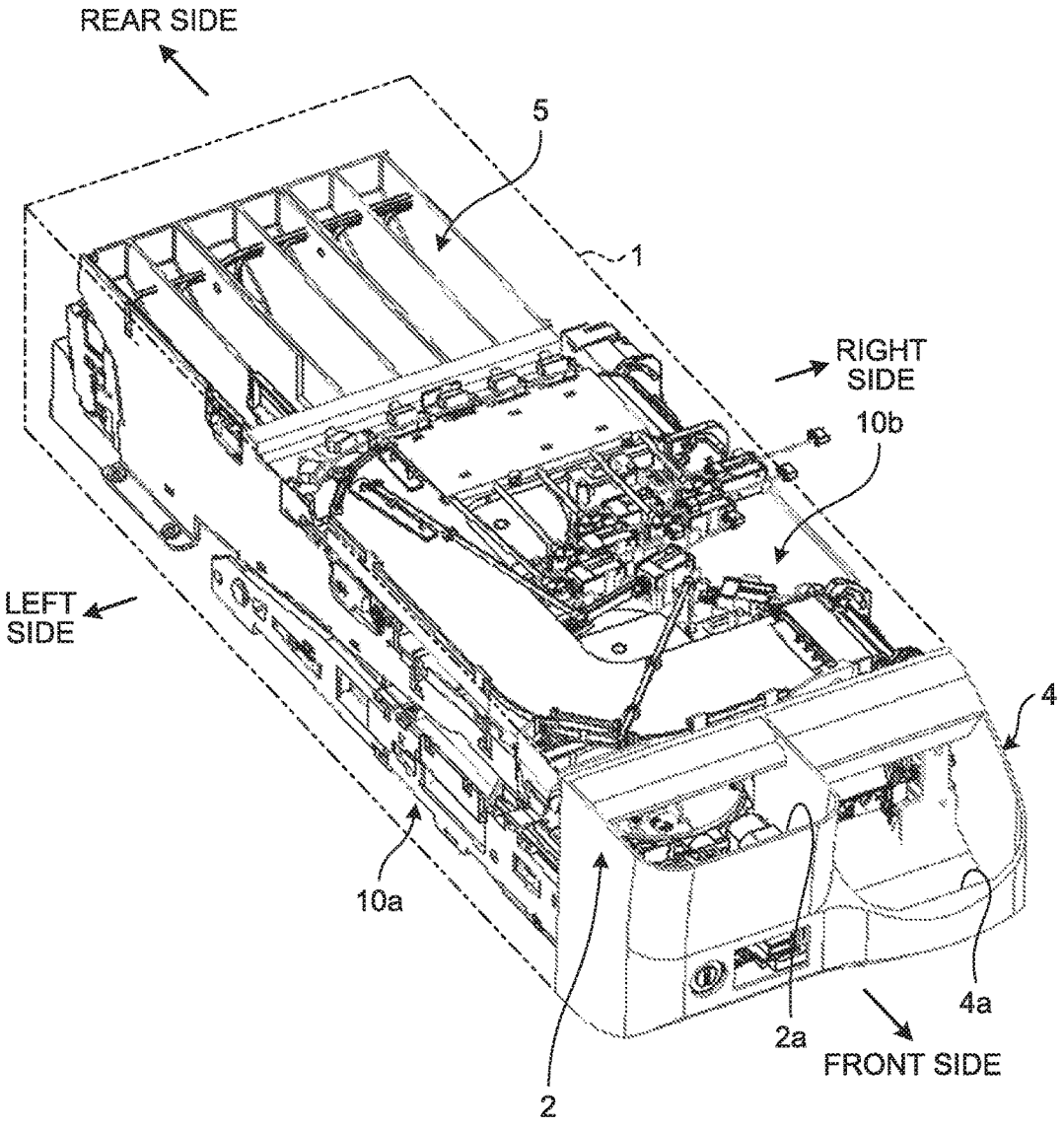
FIG. 2 is a perspective view showing the internal configuration of the coin processing apparatus to which the coin conveying device of the embodiment of the disclosure is applied.

FIG. 1 and FIG. 2 are perspective views showing an internal configuration of a coin processing apparatus to which the coin conveying device of an embodiment of the disclosure is applied.

A coin processing apparatus 1 described as an example herein is, for example, applied as a change machine, and stores input coins according to the denomination, and dispenses a stored coin under a dispensing instruction. The coin processing apparatus 1 includes a coin verification device 10*a* and a coin conveying device 10*b*.

Coin Verification Device

Figure 3:
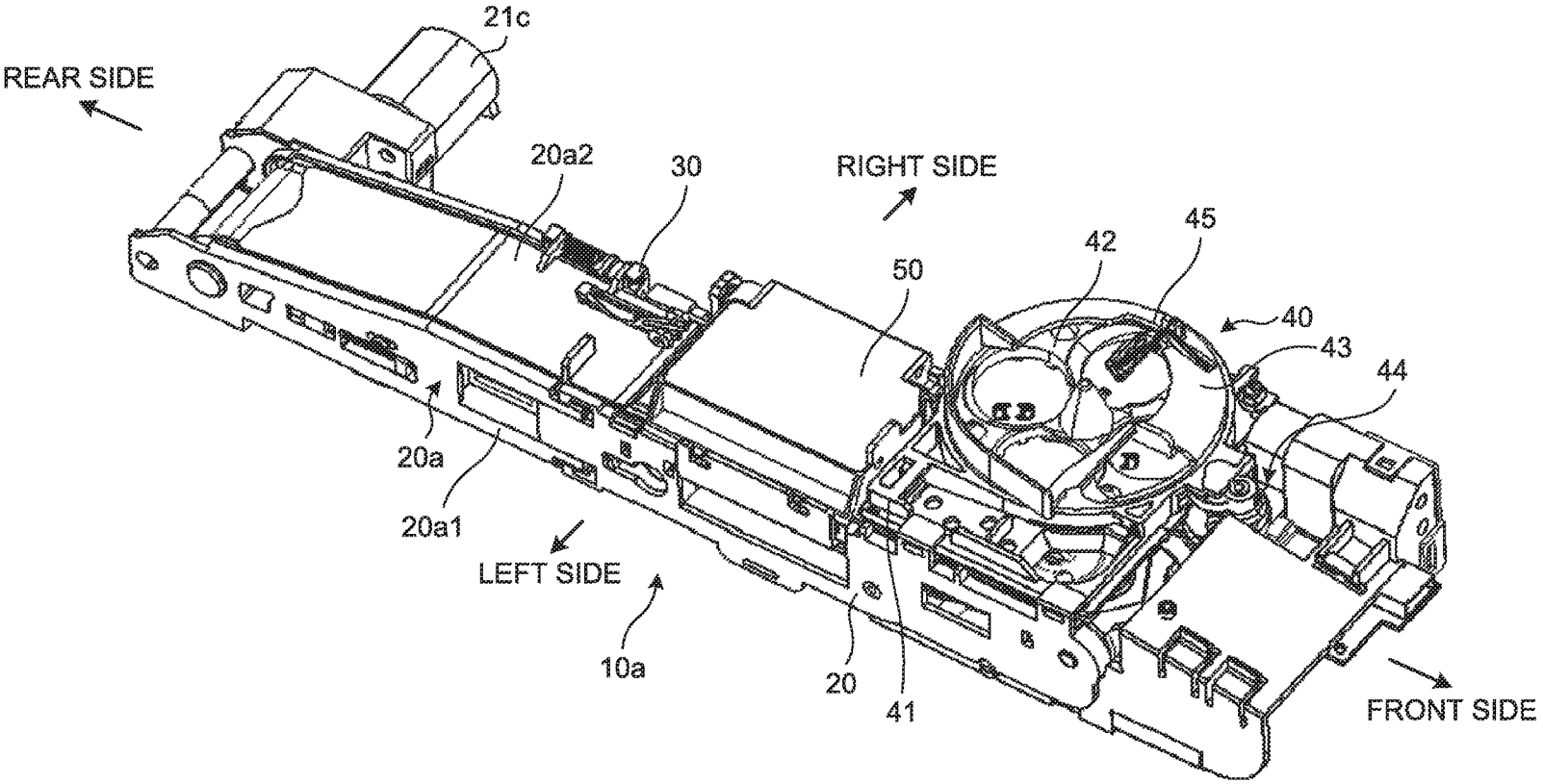
FIG. 3 is a perspective view showing a coin verification device shown in FIG. 1 and FIG. 2.
Figure 4:
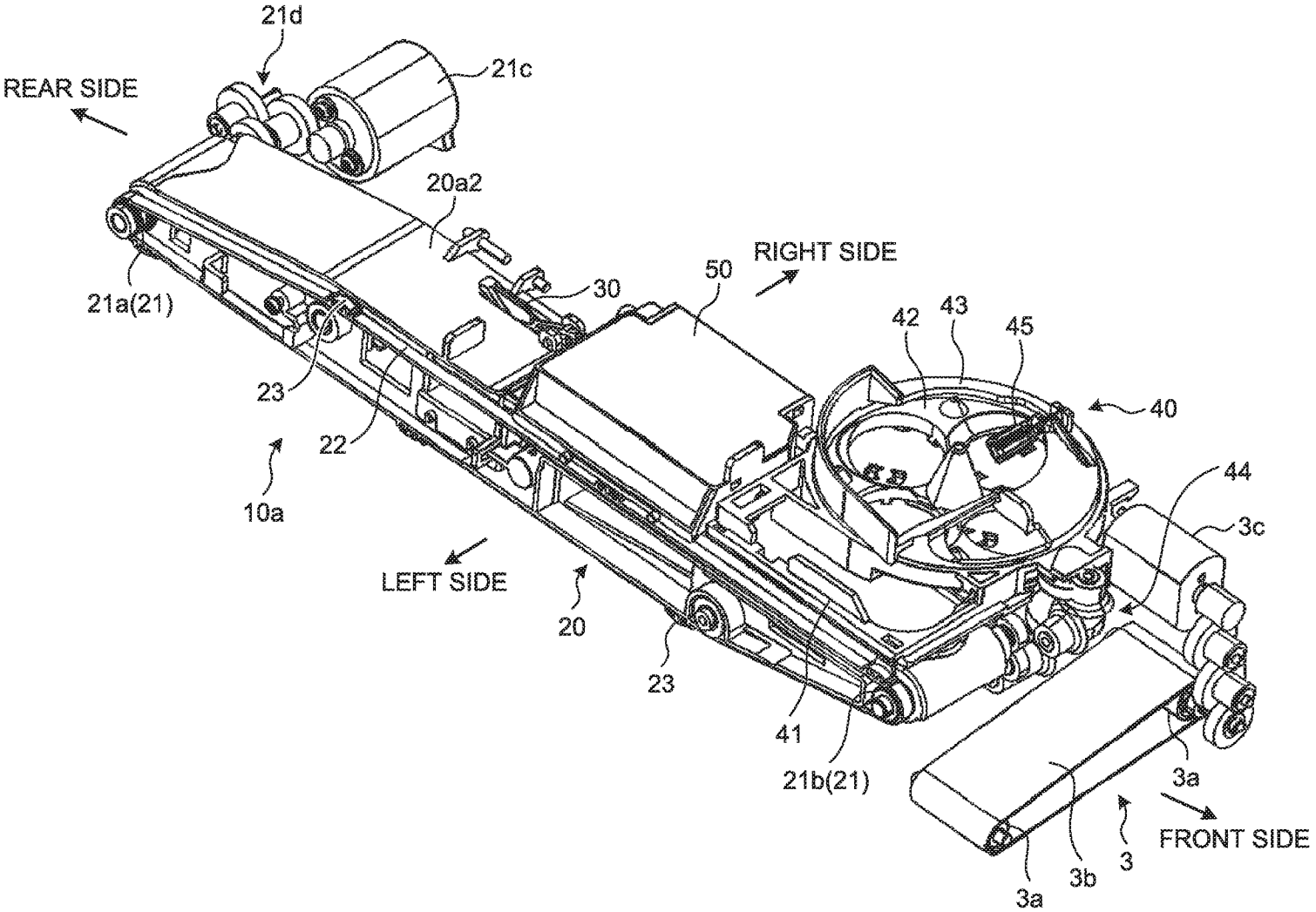
FIG. 4 is a perspective view showing components of a part of the coin verification device shown in FIG. 3 in a simplified manner.
Figure 5:
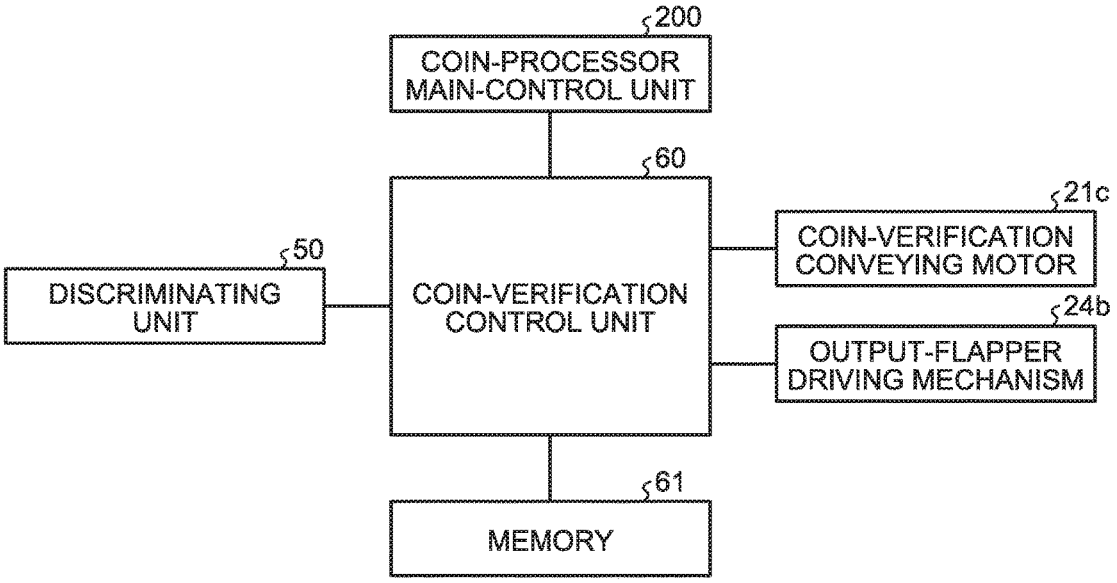
FIG. 5 is a block diagram schematically showing a control system that is characteristic to the coin verification device shown in FIG. 3 and FIG. 4.

FIG. 3 is a perspective view showing the coin verification device 10*a* shown in FIG. 1 and FIG. 2, FIG. 4 is a perspective view showing components of a part of the coin verification device 10*a* shown in FIG. 3 in a simplified manner, and FIG. 5 is a block diagram schematically showing a control system that is characteristic to the coin verification device 10*a* shown in FIG. 3 and FIG. 4.

The coin verification device 10*a* discriminates the genuineness and the denomination of a coin that is put therein through a coin insertion unit 2. The coin insertion unit 2 has a coin insertion slot 2*a*, and is a portion from which a coin is input.

The coin verification device 10*a* includes, as shown in FIG. 3 to FIG. 5, a verified-coin conveying unit (conveying unit) 20, a guide member 30, a verified-coin separating unit 40, a discriminating unit (discriminating unit) 50, and a coin-verification control unit 60.

Figure 6:
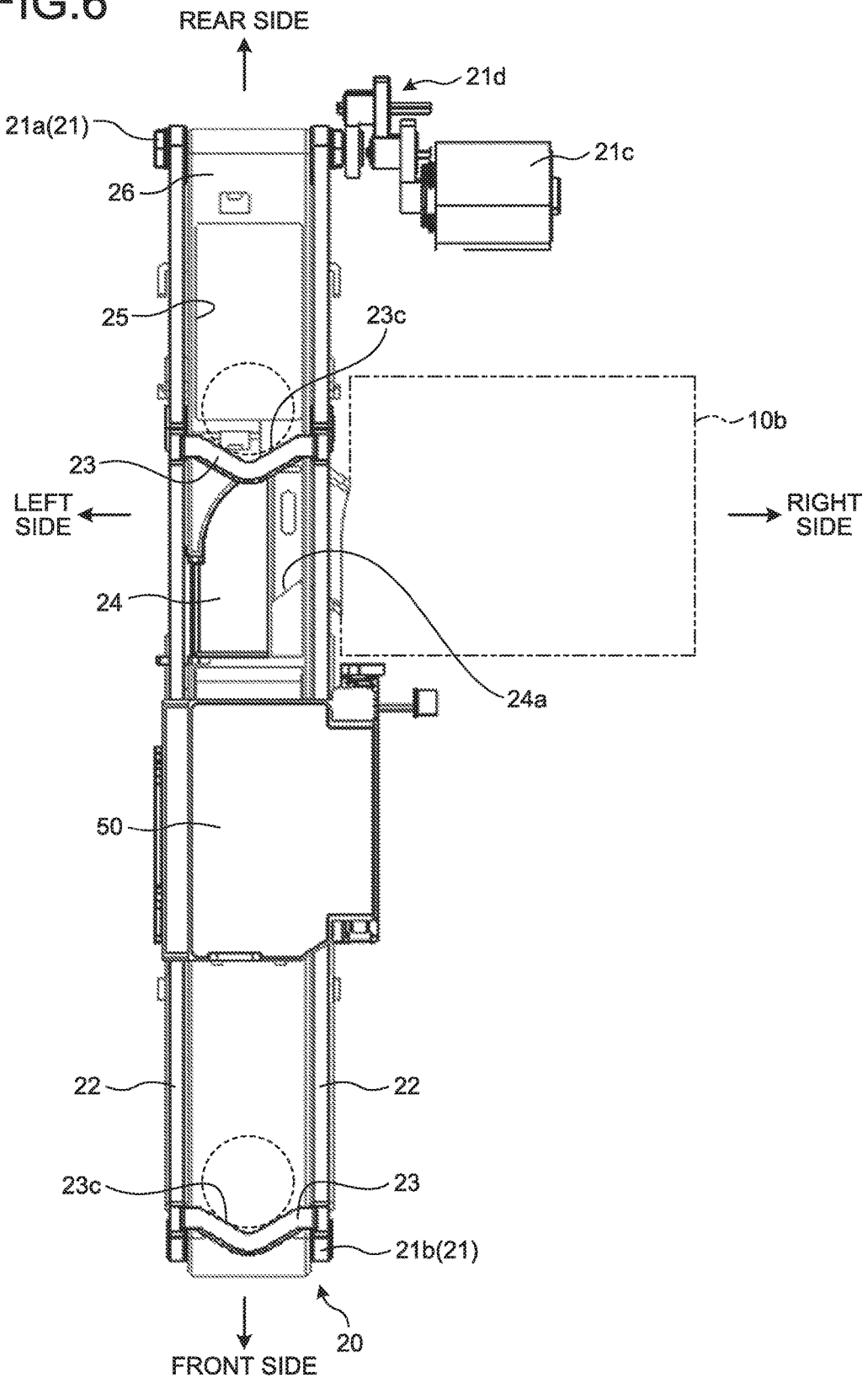
FIG. 6 is a plan view showing an essential part of the coin verification device shown in FIG. 3 and FIG. 4.
Figure 7:
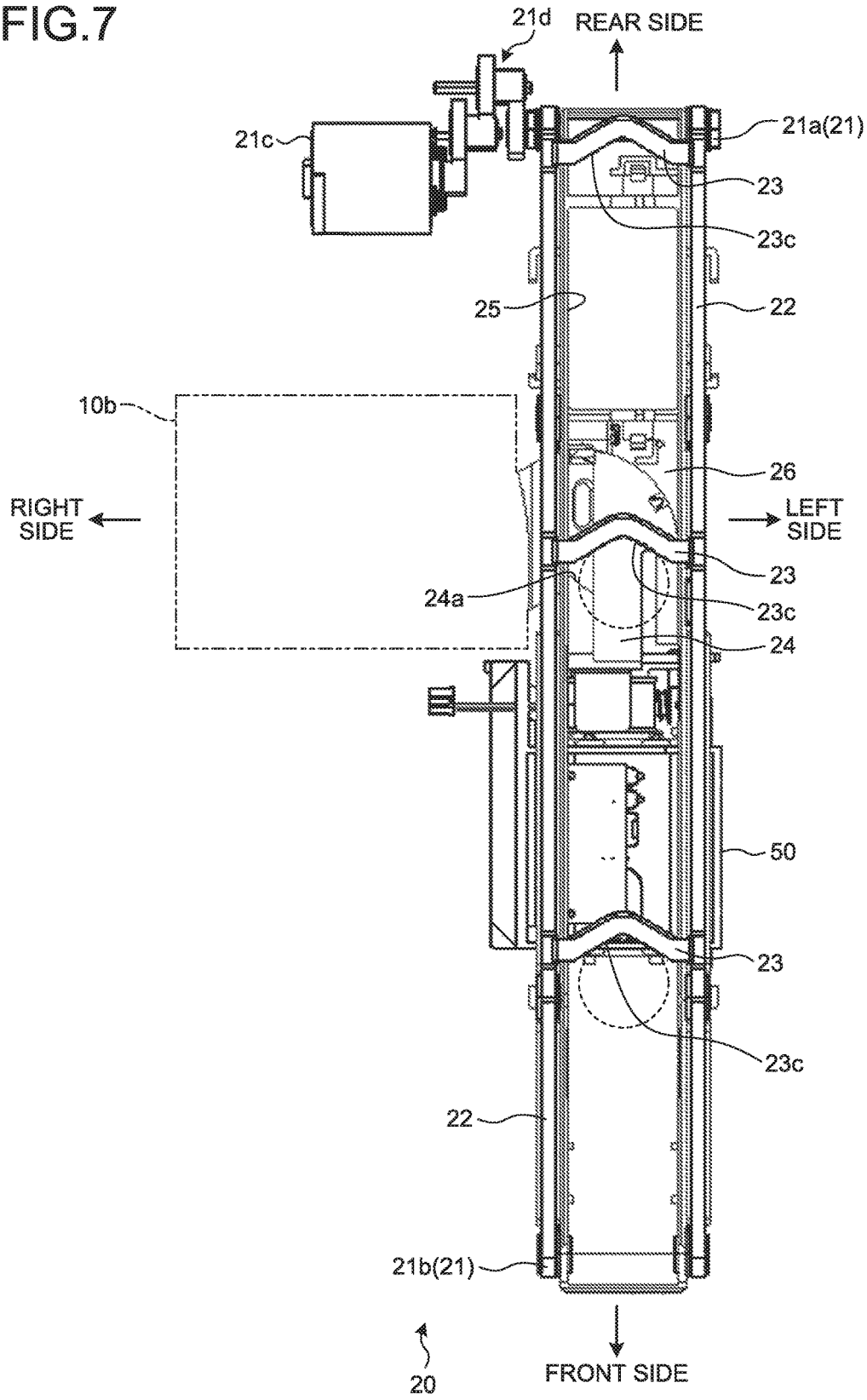
FIG. 7 is a bottom view showing an essential part of the coin verification device shown in FIG. 3 and FIG. 4.

FIG. 6 and FIG. 7 show an essential part of the coin verification device 10*a* shown in FIG. 3 and FIG. 4, and FIG. 6 is a plan view and FIG. 7 is a bottom view. As shown in FIG. 6 and FIG. 7, the verified-coin conveying unit 20 includes conveying pulleys 21, conveying belts 22, a push conveying member (conveying member) 23, an output flapper 24, and a counterfeit coin outlet 25.

Figure 8:
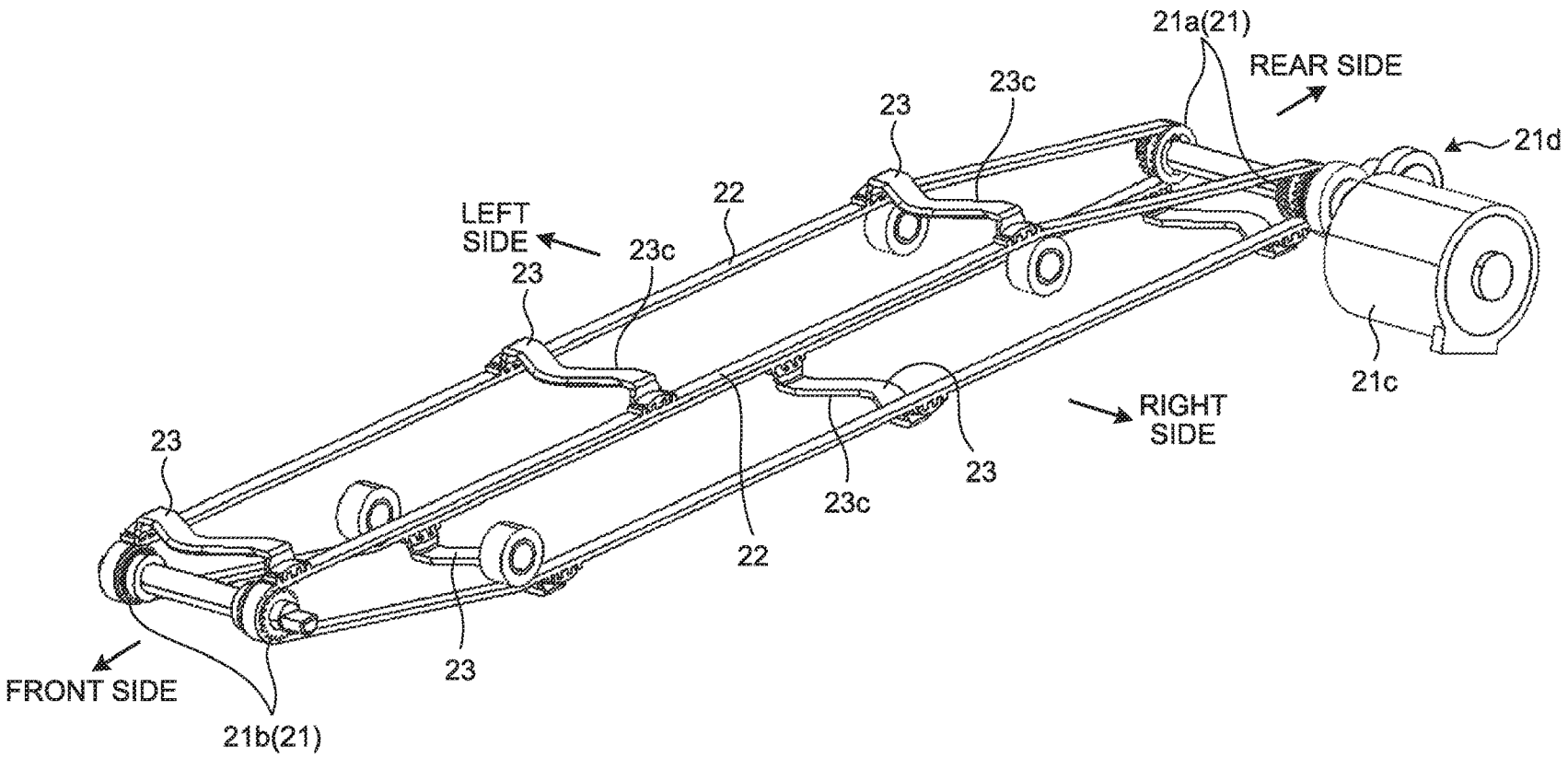
FIG. 8 is a perspective view showing an essential part of the coin verification device shown in FIG. 3 and FIG. 4.

The conveying pulley 21 is, as shown in FIG. 8, arranged to be a front-and-rear pair inside a conveying-device main unit 20*a* that is a casing. A conveying pulley 21*a* on the rear side is linked to an output axis of a coin-verification conveying motor 21*c* through a linkage gear unit 21*d*. The coin-verification conveying motor 21*c* drives when a drive command is given by the coin-verification control unit 60, and stops driving when a drive stop command is given by the coin-verification control unit 60.

The conveying pulley 21*a* on the rear side described above is a driving pulley that rotates about a center axis of itself with by a driving force of the coin-verification conveying motor 21*c*. The conveying pulley 21*a* on the rear side rotates counterclockwise when viewed from a left side, with the driving force given by the coin-verification conveying motor 21*c*.

The conveying belts 22 are arranged in a left-and-right pair, and are endlessly put between the respective conveying pulleys 21 under tension. The conveying belt 22 is displaced in an extending direction thereof, with rotation of the conveying pulley 21*a* by the driving force of the coin-verification conveying motor 21*c*. More specifically, the conveying belt 22 is displaced in such a manner that an upper portion moves toward a rear side and a lower portion moves toward a forward side with rotation of the conveying pulley 21*a* on the rear side.

A conveying pulley 21*b* on the front side that is linked to the conveying pulley 21*a* on the rear side through the conveying belt 22 rotates about a center axis of itself with the rotation of the conveying pulley 21*a* on the rear side in the counterclockwise direction when viewed from the left. That is, the conveying pulley 21*b* is a driven pulley that is rotated according to the rotation of the conveying pulley 21*a* on the rear side.

Figure 9:
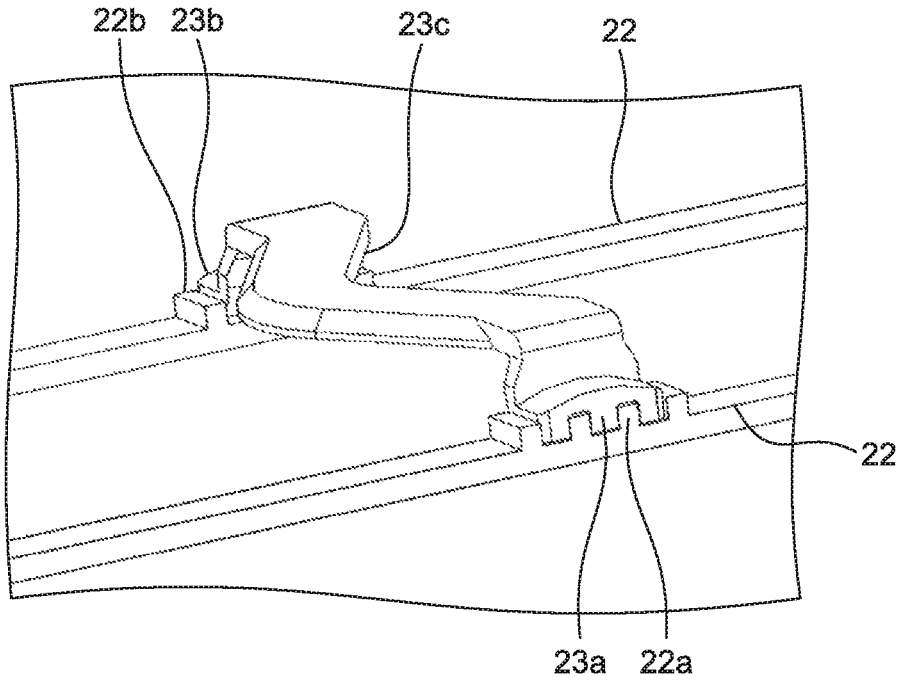
FIG. 9 is a perspective view showing a portion at which a conveying belt and a push conveying member are attached to each other in an enlarged manner.

There are a plurality of the push conveying members 23 arranged such that each of the members 23 is arranged astride a left and right pair of the conveying belts 22 at regular intervals along the extending direction of the conveying belts 22. As shown in FIG. 9, in the push conveying member 23, a right-end concave-convex portion 23*a* that is arranged on a right end is engaged with a right-side concave-convex portion 22*a* that is arranged in the conveying belt 22 on the right side, and a left-end concave-convex portion 23*b* that is arranged on a left end is engaged with a left-side concave-convex portion 22*b* that is arranged in the conveying belt 22 on the left side, thereby being fixed astride a right and left pair of the conveying belts 22. Thus, the push conveying members 23 are displaced as the conveying belts 22 are displaced along the extending direction of the conveying belts 22. While the push conveying members 23 are fixed with the concave-convex portions 23*a*, 23*b* at the left and right ends engaged with the concave-convex portions 22*a*, 22*b* of the conveying belts 22, movement in left and right directions relative to the conveying belts 22 is controlled by both left and right side portions 20*a*1 of the conveying-device main unit 20*a*, movement in an upward direction relative to the conveying belt 22 is controlled by a top portion 20*a*2 of the conveying-device main unit 20*a*, and movement in a downward direction relative to the conveying belt 22 is controlled by a bottom portion (not shown) of the conveying-device main unit 20*a*.

Figure 10:
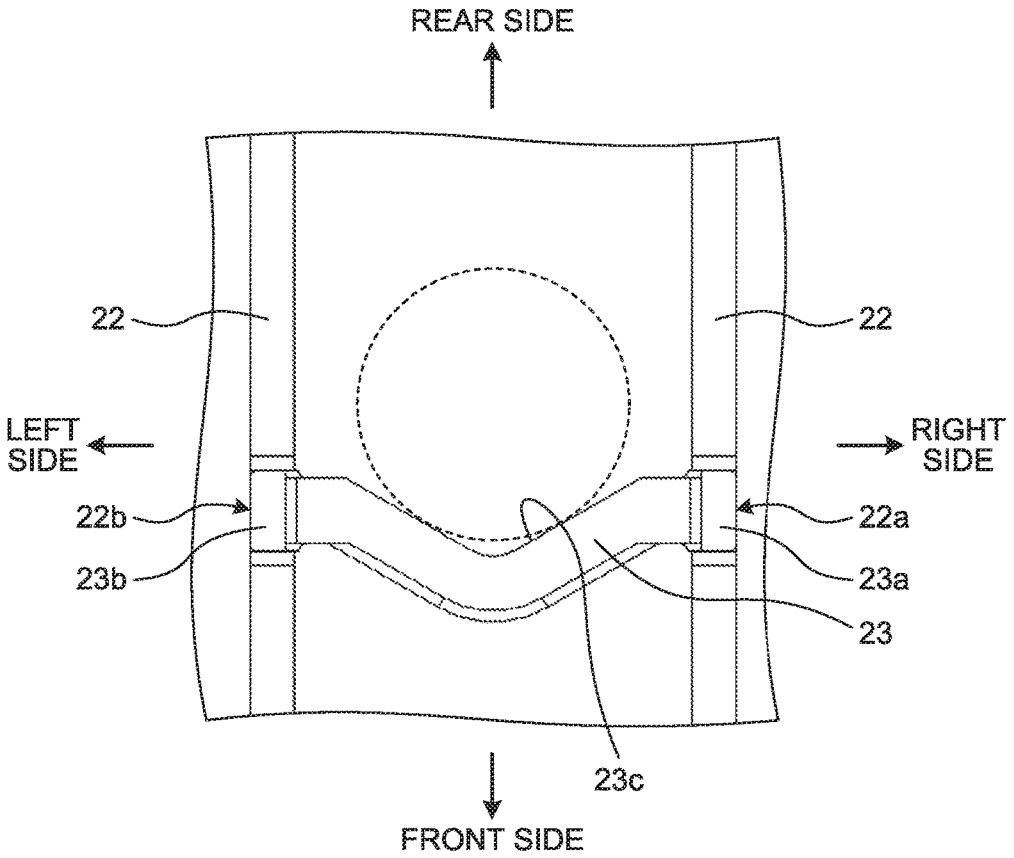
FIG. 10 is a plan view showing the push conveying member that is displaced toward a rear side of the conveying belt in an enlarged manner.

In the push conveying member 23, a surface 23*c* that faces toward a downstream side in the direction of displacement of the conveying belt 22, that is a surface facing rearward at a portion above the conveying belt 22 and facing frontward at a portion below the conveying belt 22, is formed in a V-shape. That is, the push conveying member 23 forms a V-shape on the surface 23*c* that faces toward the downstream side in the direction of displacement of the conveying belt 22, as shown in FIG. 10, with a surface inclined toward the upstream side in the direction of displacement as it approaches toward the left side and a surface inclined toward the upstream side in the direction of displacement as it approaches toward the right side connected at a central part.

The output flapper 24 is arranged at a conveyance base portion 26 that is arranged between a left and right pair of the conveying belts 22 as shown in FIG. 6 and FIG. 7. More specifically, the output flapper 24 is arranged at a left end portion of an outlet 24*a* that is formed at the conveyance base portion 26 in a swingable manner. The outlet 24*a* is an opening that communicates with an output path, and enables a coin that passes through itself to be put out to the coin conveying device 10*b* through the output path.

The output flapper 24 is closed normally so as to suppress passage of coins through the outlet 24*a*. As an output-flapper driving mechanism 24*b* drives, the output flapper 24 swings in an opening direction to open the outlet 24*a*. The output-flapper driving mechanism 24*b* drives to cause the output flapper 24 to swing in the opening direction when a drive command is given by the coin-verification control unit 60, and stops driving when a drive stop command is given by the coin-verification control unit 60 to cause the output flapper 24 to close the outlet 24*a*.

The counterfeit coin outlet 25 is a rectangular-shaped opening that is formed on the rear side of the outlet 24*a* at the conveyance base portion 26 as shown in FIG. 6 and FIG. 7. The counterfeit coin outlet 25 has a sufficient size to allow passage of coins. A coin that has passed through this counterfeit coin outlet 25 is placed at a bottom part.

Figure 11:
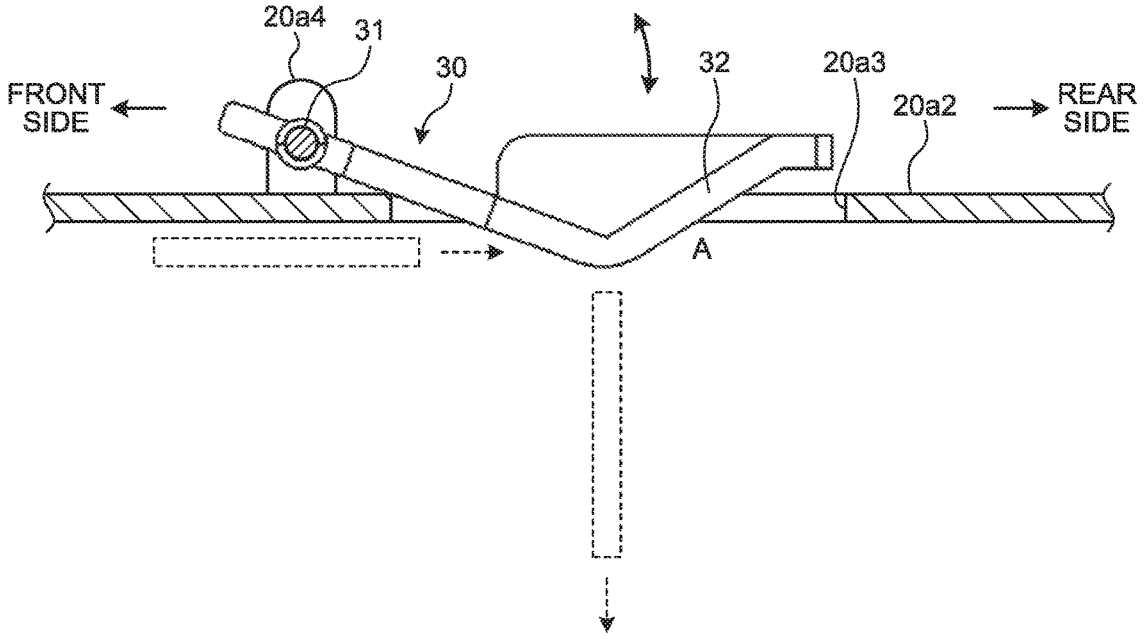
FIG. 11 is an explanatory diagram showing a guide member and a structure therearound shown in FIG. 3 and FIG. 4 in an enlarged manner.

The guide member 30 is arranged at the top portion 20*a*2 of the conveying-device main unit 20*a* at a portion above the outlet 24*a* as shown in FIG. 3 and FIG. 4. This guide member 30 has a guide axis 31 and a guide action unit 32 as shown in FIG. 11.

The guide axis 31 is a cylindrical member that extends along the left and right direction. The guide action unit 32 is a member that extends outward in a direction of diameter of the guide axis 31, more specifically, toward the rear side.

The guide member 30 is arranged swingably about a center axis of the guide axis 31 by such an arrangement that the guide axis 31 is set at a guide support piece 20*a*4 arranged at the top portion 20*a*2 in such a manner that the guide action unit 32 passes through a guide opening 20*a*3 formed at the top portion 20*a*2.

More specifically, the guide member 30 is arranged swingably such that a lower end portion of the guide action unit 32 moves back and forth in a passage region A of coins that is conveyed toward the rear side by the verified-coin conveying unit 20, and is normally in a state in which the lower end portion of the guide action unit 32 has entered the passage region A. The guide member 30 allows, when the outlet 24*a* is open by the output flapper 24, a coin to pass toward the rear side by making a swinging movement of receding from the passage region A by being pushed by the coin passing through the passage region A, and abuts on a coin passing through the passage region A, on the other hand, when the outlet 24*a* is opened by the output flapper 24, to guide the coin to the outlet 24*a* abutting on the coin passing through the passage region A.

The verified-coin separating unit 40 sends coins input through the coin insertion unit 2 to the verified-coin conveying unit 20, separating to each coin.

Figure 12:
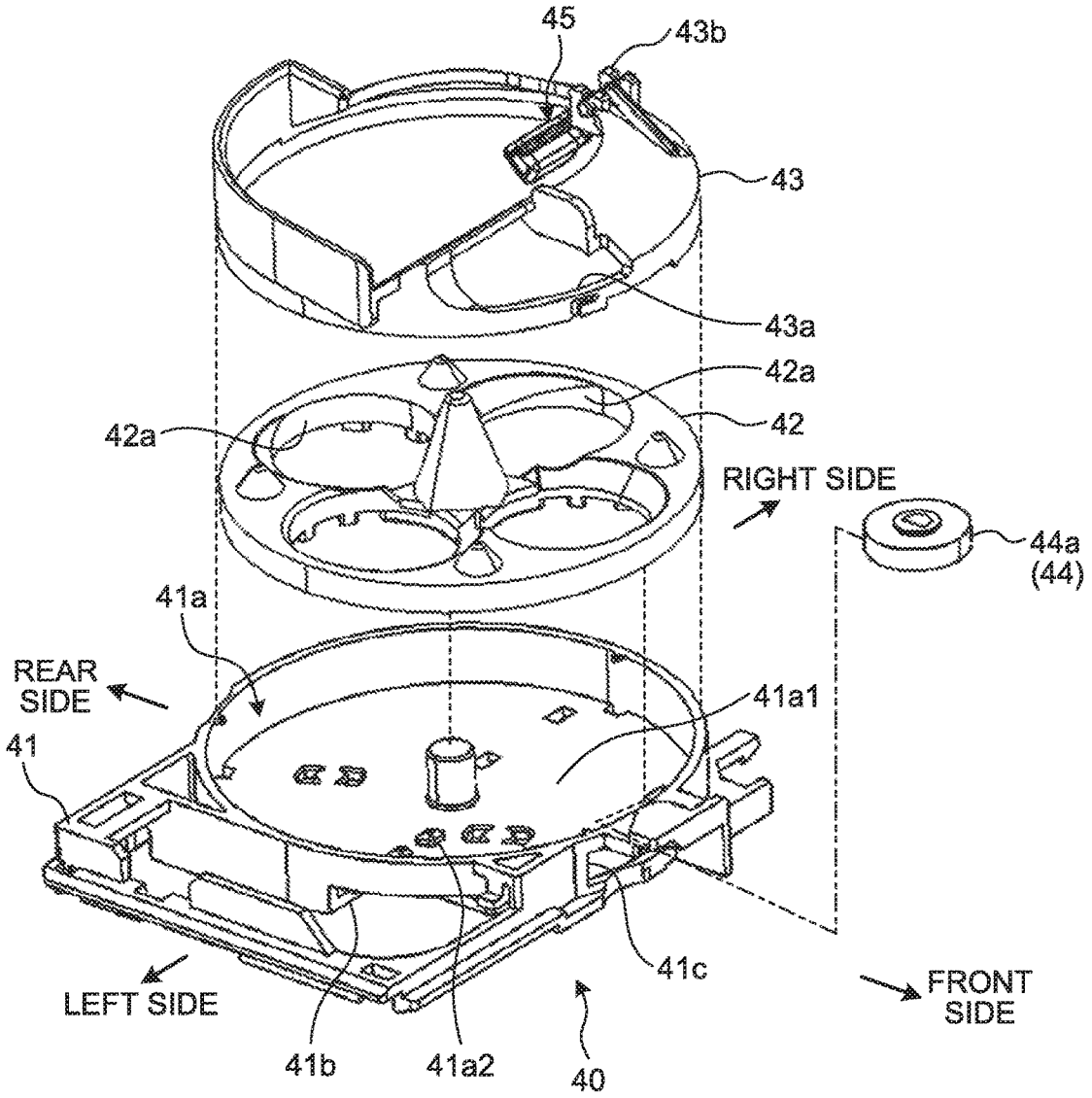
FIG. 12 is an exploded perspective view showing main components of a verified-coin separating unit shown in FIG. 3 and FIG. 4 in a separated manner.

FIG. 12 is an exploded perspective view showing main components of the verified-coin separating unit 40 shown in FIG. 3 and FIG. 4 in a separated manner. As shown in FIG. 12, the verified-coin separating unit 40 is constituted of a separator main unit 41, a rotator 42, and a separator cover 43.

Figure 13:
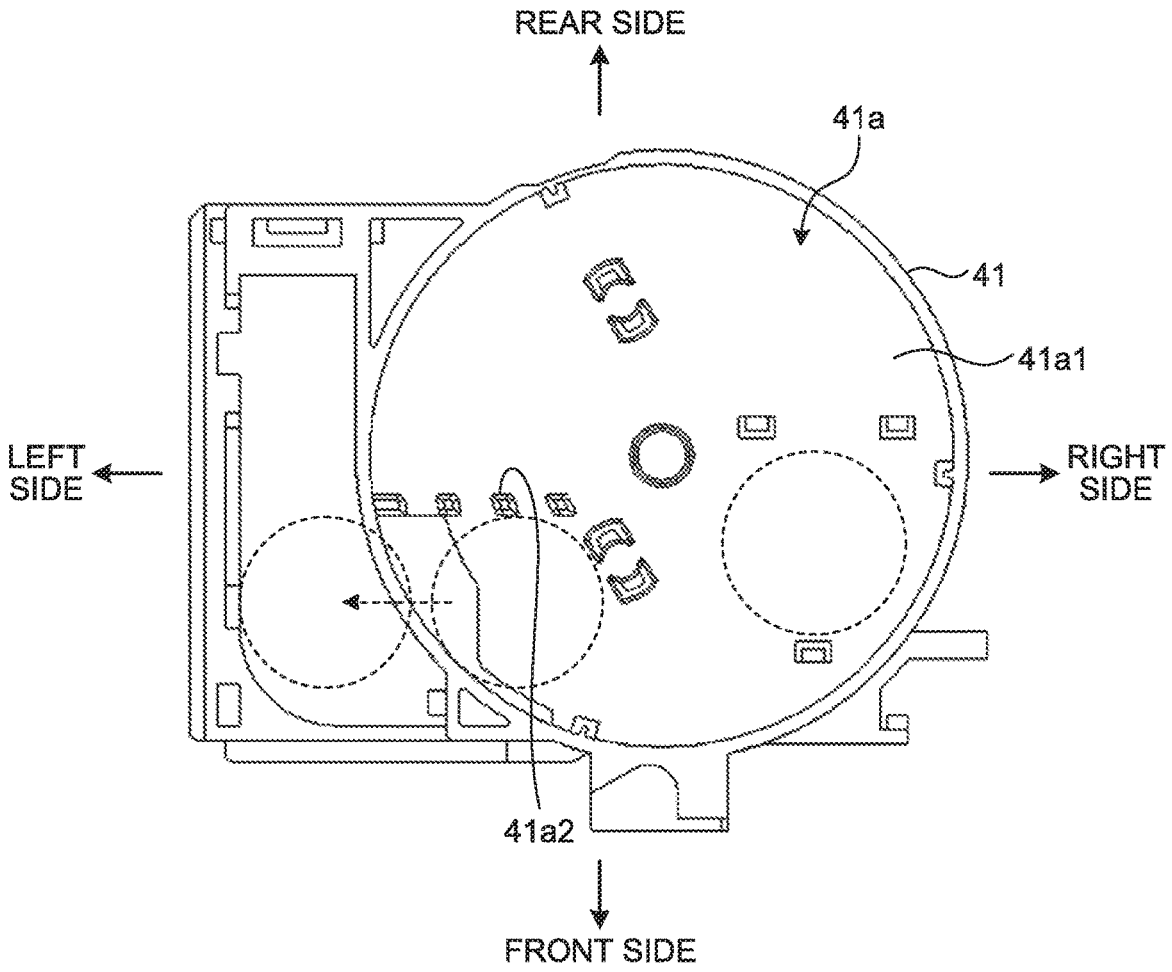
FIG. 13 is a plan view of a separator main unit shown in FIG. 12.

The separator main unit 41 includes a rotator housing unit 41*a* in a cylindrical shape with a bottom, and a feeding opening 41*b* through which a coin is fed to the verified-coin conveying unit 20, and a driving-force giving opening 41*c* to give a rotation driving force to the rotator 42 are formed therein. On a bottom surface portion 41*a*1 of the rotator housing unit 41*a* in this separator main unit 41, multiple guiding protrusions 41*a*2 to guide a coin to the feeding opening 41*b* are formed to protrude upward as shown in FIG. 13.

The rotator 42 has a substantially a disc shape, and is housed in the rotator housing unit 41*a* of the separator main unit 41 rotatably about a center axis of itself. In the rotator 42, multiple coin passage holes 42*a* (four holes in the illustrated example) are formed on the same circumference about the center axis.

On a side surface of the rotator 42, a gear 44*a* of a driving-force transfer unit 44 is engaged therewith through the driving-force giving opening 41*c* described above. The driving-force transfer unit 44 is present between the conveying pulley 21*b* on the front side and the rotator 42 as shown in FIG. 4, and transfers a rotation driving force of the conveying pulley 21 to the rotator 42.

As described above, as the conveying pulley 21*b* on the front side is a driven pulley that is rotated according to rotation of the conveying pulley 21*a* on the rear side, the rotation driving force of the rotator 42 is given by the coin-verification conveying motor 21*c*. That is, the rotation of the rotator 42 and the rotation of the conveying pulley 21 are given by a common driving source, and displacement of the rotator 42 and the conveying belt 22 are synchronized.

The separator cover 43 is arranged to cover the rotator housing unit 41*a* of the separator main unit 41. In this separator cover 43, an inlet 54*a* and a movable flapper 45. An inlet 43*a* is an opening to put a coin input at the coin insertion unit 2 into the rotator 42 in the rotator housing unit 41*a*.

Figure 14:
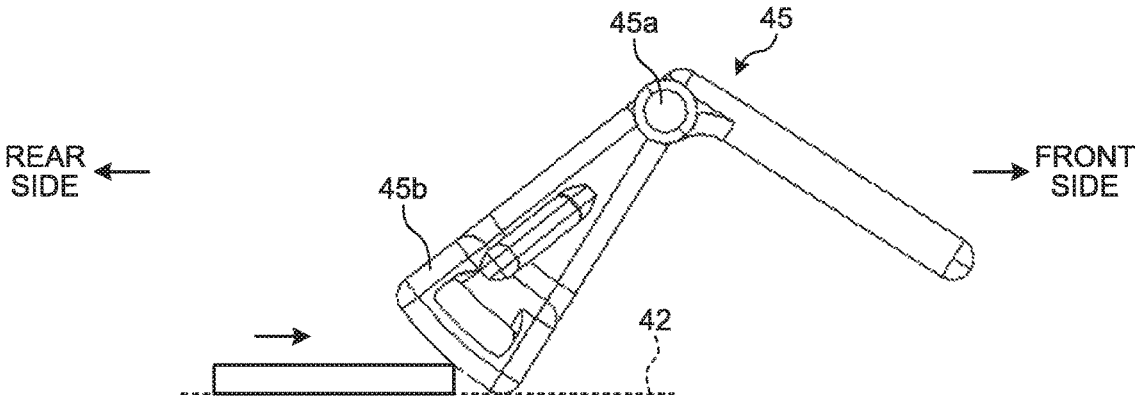
FIG. 14 is a left side view showing a movable flapper shown in FIG. 12.

The movable flapper 45 has a movable axis unit 45*a* and a movable action unit 45*b* as shown in FIG. 14. The movable axis unit 45*a* is a cylindrical member that extends in a left and right direction. The movable action unit 45*b* is a member that extends outward in a direction of diameter of the movable axis unit 45*a*, and more specifically, downward on the rear side.

The movable flapper 45 is arranged swingably about a center axis of the movable axis unit 45*a* by such an arrangement that the movable axis unit 45*a* is set at a movable support piece 43*b* arranged at the separator cover 43 in such a manner that the movable action unit 45*b* passes through the inlet 43*a*. More specifically, the movable flapper 45 is swingably arranged in such a manner that a part of an end portion of the movable action unit 45*b* is in contact with an upper surface of the rotator 42 as shown in FIG. 14.

Figure 15:
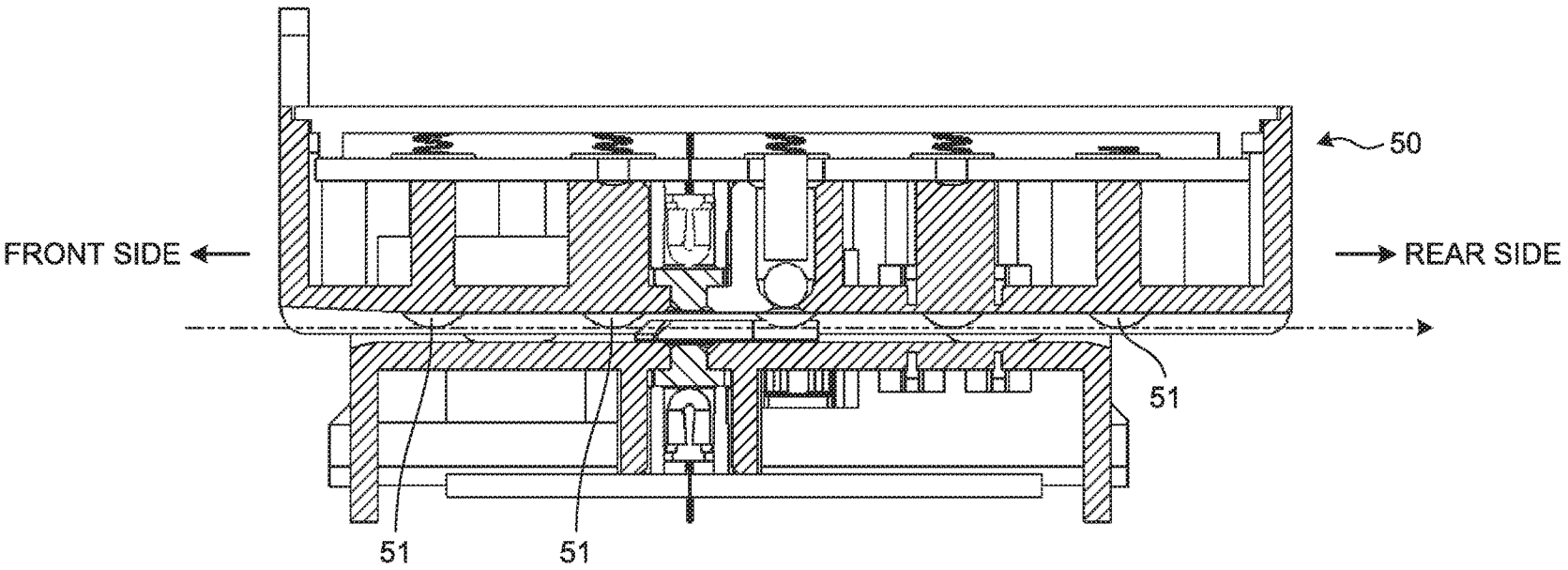
FIG. 15 is a vertical cross-section of a discriminating unit shown in FIG. 3 and FIG. 4.

The discriminating unit 50 is arranged at a position that is on the rear side from the verified-coin separating unit 40, and is on the front side from the outlet 24*a* as shown in FIG. 3 and FIG. 4. This discriminating unit 50 is to discriminate the authenticity and denominations of a coin when the coin that is being conveyed toward the rear side from the verified-coin conveying unit 20 passes a predetermined discrimination area. The discriminating unit 50 gives a discrimination result to the coin-verification control unit 60 as a discrimination signal. Furthermore, the discriminating unit 50 includes multiple ball pressers 51 as shown in FIG. 15. These ball pressers 51 are to press a coin passing toward the rear side from above.

The coin-verification control unit 60 is to perform overall control of the operation of the coin verification device 10*a* according to a program and data stored in a memory 61. The coin-verification control unit 60 can be implemented by causing a processing device such as a central processing unit, to execute a program, that is, by software, or can be implemented by hardware such as an integrated circuit (IC), or can be implemented by combining software and hardware.

In the coin verification device 10*a* configured as above, when multiple coins are input through the coin insertion unit 2 and an operation command is given by a coin-processor main-control unit 200 that performs overall control of operation of the coin processing apparatus 1 to the coin-verification control unit 60, the coin-verification control unit 60 gives a drive command to the coin-verification conveying motor 21*c*.

Thus, the coin-verification conveying motor 21*c* is activated, and in the verified-coin conveying unit 20, the conveying pulley 21 rotates in a counterclockwise direction viewed from the left to displace the conveying belt 22 along the extending direction. Moreover, with the rotation of the conveying pulley 21, the rotator 42 of the verified-coin separating unit 40 rotates through the driving-force transfer unit 44 in a clockwise direction viewed from the above.

When coins input from the coin insertion unit 2 are brought to the upper surface of the rotator 42 through the inlet 43*a* of the separator cover 43, the verified-coin separating unit 40 guides these coins to the respective coin passage holes 42*a* in a laid-down state. As described above, as the movable flapper 45 is swingably arranged in a state in which a part at the end portion of the movable action unit 45*b* is in contact with the upper surface of the rotator 42 at the separator cover 43, the movable action unit 45*b* of the movable flapper 45 presses the coins on the upper surface of the rotator 42 to guide the coins to the coin passage holes 42*a* in the laid-down state. Thus, the coins guided to the coin passage holes 42*a* are stacked in the coin passage holes 42*a*.

Out of the coins guided into the coin passage holes 42*a* and stacked therein, a coin at the bottom slides on the bottom surface portion 41*a*1 of the rotator housing unit 41*a* in the separator main unit 41 by the rotation of the rotator 42. As the guiding protrusions 41*a*2 are formed on the bottom surface portion 41*a*1 of the rotator housing unit 41*a*, as shown in FIG. 13, the verified-coin separating unit 40 separates the coin at the bottom that has come into contact with the guiding protrusions 41*a*2 from the coin passage hole 42*a*, and provides it to the verified-coin conveying unit 20 through the feeding opening 41*b*. That is, the verified-coin separating unit 40 sends coins input through the coin insertion unit 2 to the verified-coin conveying unit 20 in a state separated from each other.

The coin provided to the verified-coin conveying unit 20 through the feeding opening 41*b* is placed in a laid-down state on a top surface of the conveyance base portion 26. As described above, because the conveying belts 22 are displaced in the extending direction, the push conveying members 23 fixed to the conveying belts 22 press the coin placed on the top surface of the conveyance base portion 26 toward the rear side, thereby conveying the coin toward the rear side.

The push conveying member 23 has the surface 23*c* that faces the downstream side in the direction of displacement of the conveying belt 22 and is formed in a V-shape, and therefore, as shown in FIG. 10, the surface 23*c* facing the downstream side is to be a surface pressing the coin as the conveying belts 22 are displaced, and can convey the coin toward the rear side in a state in which the coin is brought to a central part in the left and right direction.

When the conveyed coin reaches the discrimination area of the discriminating unit 50 by thus being conveyed toward the rear side pushed by the push conveying members 23, the discriminating unit 50 discriminates the authenticity and denominations of the coin. This discriminating unit 50 sends a discrimination result to the coin-verification control unit 60 as a discrimination signal.

The coin-verification control unit 60 receives the discrimination signal from the discriminating unit 50, and gives a drive command to the output-flapper driving mechanism 24*b* when the discrimination result indicates a genuine coin. Thus, the output-flapper driving mechanism 24*b* starts driving, and the output flapper 24 slides in the opening direction to open the outlet 24*a*. When the output flapper 24 thus opens the outlet 24*a*, the coin being conveyed toward the rear side pressed by the push conveying members 23 passes through the outlet 24*a* while touching the guide member 30 and changing the posture, to be output to the coin conveying device 10*b*. After the coin discriminated as a genuine coin passes through the outlet 24*a*, the coin-verification control unit 60 gives a drive stop command to the output-flapper driving mechanism 24*b*. Thus, the outlet 24*a* is closed by the output flapper 24.

On the other hand, when the coin-verification control unit 60 receives the discrimination signal from the discriminating unit 50 and the discrimination result indicates a counterfeit coin, the coin-verification control unit 60 maintains a closed state of the outlet 24*a* with the output flapper 24 without giving a drive command to the output-flapper driving mechanism 24*b*.

The coin that has passed the discrimination area in a state of being pushed by the push conveying members 23 and conveyed to the rear side passes the upper surface of the output flapper 24, and passes through the counterfeit coin outlet 25 to be dropped downward. The coin thus dropped downward is placed at a bottom portion of the conveying-device main unit 20*a* in a laid-down state.

The downward portions of the conveying belts 22 are displaced toward the front side by rotation of the conveying pulley 21. Therefore, at the downward portion of the verified-coin conveying unit 20, as shown in FIG. 7, the push conveying members 23 fixed to the conveying belts 22 move toward the front side, and therefore, the push conveying member 23 can convey a coin placed on the bottom portion toward the front side by pushing the coin toward the front side. At this time, as the push conveying member 23 has the surface 23*c* facing the downstream side in the direction of displacement of the conveying belts 22 is formed in a V-shaped, the push conveying member 23 can convey the coin toward the rear side in a state in which the coin is brought to the central part in the left and right direction.

Thus, the verified-coin conveying unit 20 sends a coin (counterfeit coin) conveyed toward the front side to an ejection unit 3 (refer to FIG. 4).

The ejection unit 3 is structured such that an ejection belt 3*b* is endlessly arranged by being hooked between a left and right pair of ejection pulleys 3*a* under tension. This ejection unit 3 sends a coin ejected thereby by rotation of the ejection pulley 3*a* on a right side by a driving force of the ejection motor 3*c* to a payout unit 4, to cause to eject the coin from a coin ejection outlet 4*a*(refer to FIG. 1 and FIG. 2) arranged in the payout unit 4.

As explained above, the coin verification device 10*a* discriminates the authenticity and denominations of coins input through the coin insertion unit 2, and sends a coin that is discriminated as a genuine coin to the coin conveying device 10*b*, and ejects a coin that is discriminated as a counterfeit coin to outside through the payout unit 4.

According to the coin verification device 10*a*, verified-coin conveying unit 20 conveys a coin that has been conveyed toward the rear side and has been discriminated as a counterfeit coin by the discriminating unit 50 is conveyed toward the front side after passing through the counterfeit coin outlet 25, and therefore, a length in a front-rear direction of the verified-coin conveying unit 20 can be shortened, thereby enabling to downsize the coin processing apparatus 1.

According to the coin verification device 10*a*, in the push conveying member 23 constituting the verified-coin conveying unit 20, as the surface 23*c* that pushes a coin as the conveying belts 22 are displaced is formed in a V shape, a coin can be conveyed in a state brought to a central part in a left and right direction, and thus, coins can be conveyed stably, controlling a conveyance position of a coin, and the accuracy of discrimination performed by the discriminating unit 50 can be improved.

Con Conveying Device

Figure 16:
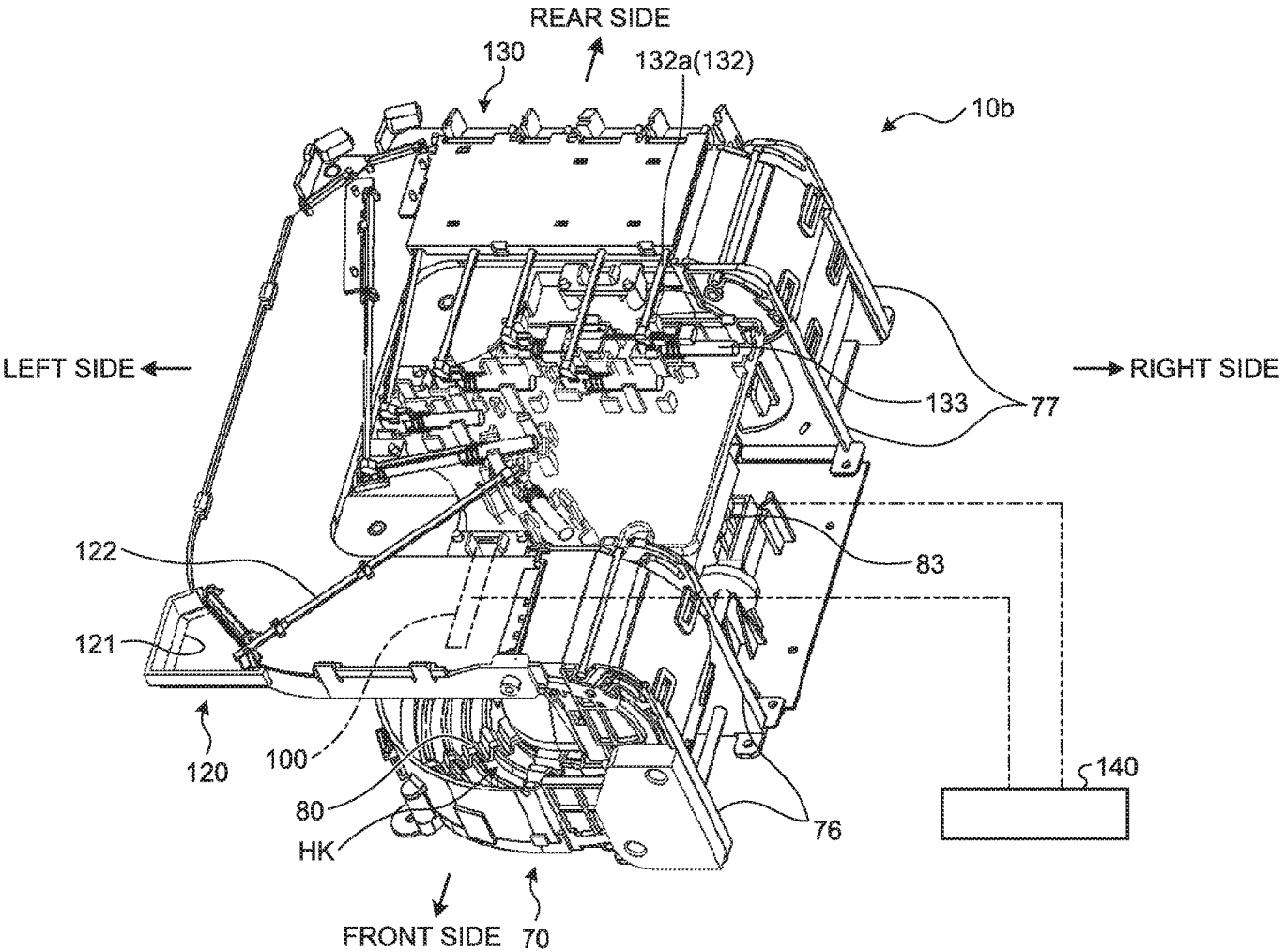
FIG. 16 is a perspective view showing the coin conveying device shown in FIG. 1 and FIG. 2.
Figure 17:
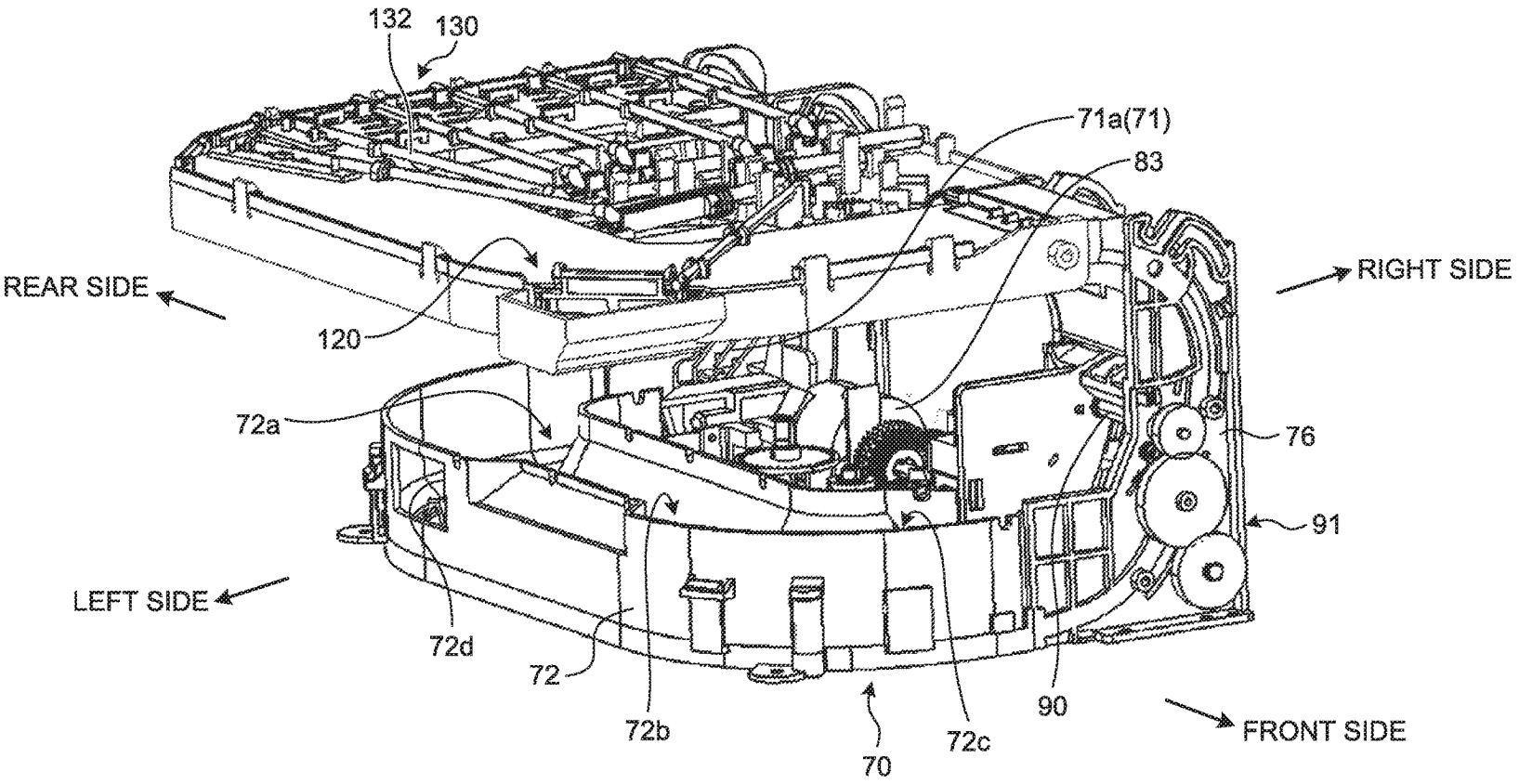
FIG. 17 is a perspective view showing a part of components of the coin conveying device shown in FIG. 16 in a simplified manner.
Figure 18:
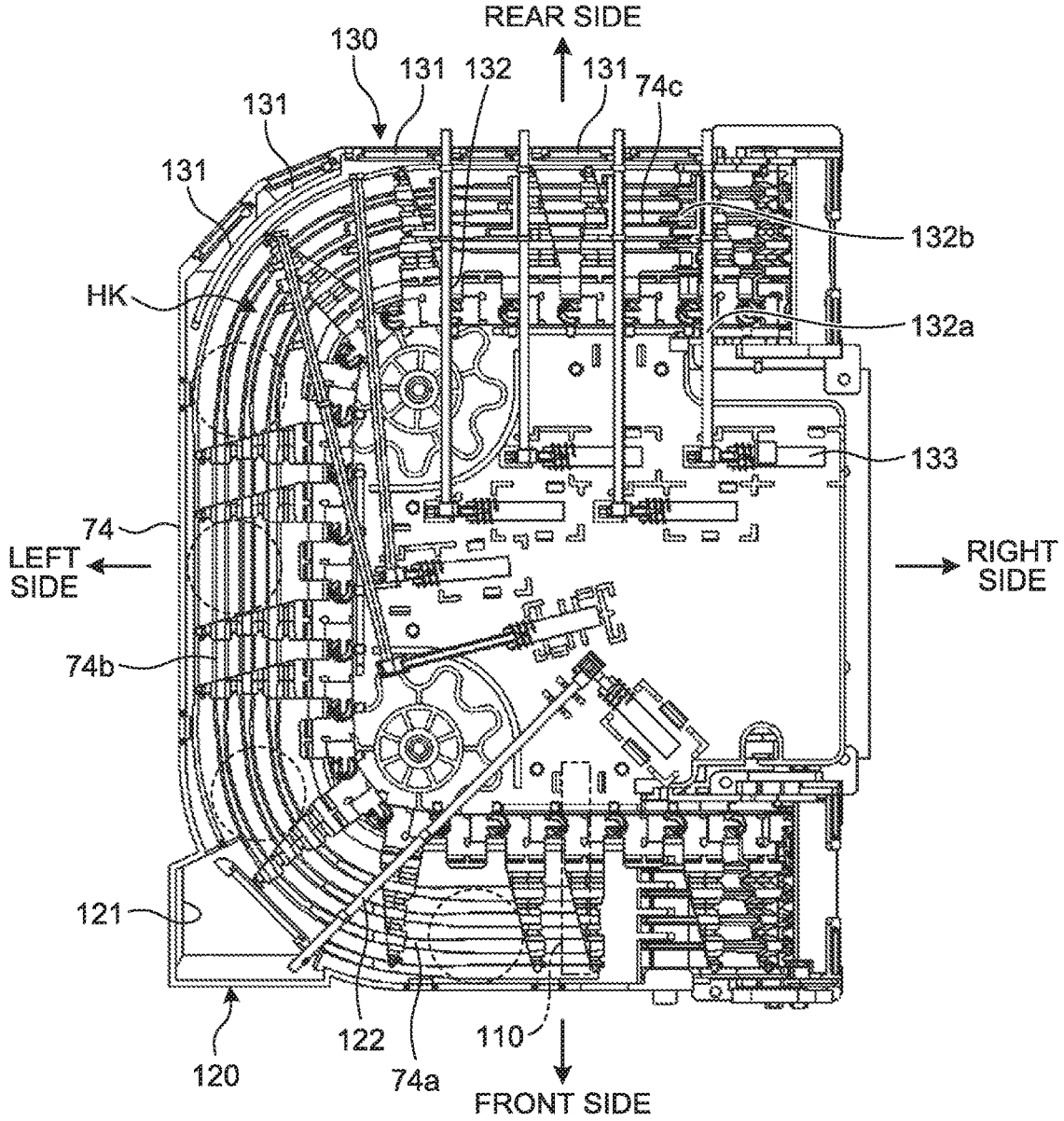
FIG. 18 is a plan view showing a part of components of the coin conveying device shown in FIG. 16 in a simplified manner.
Figure 19:
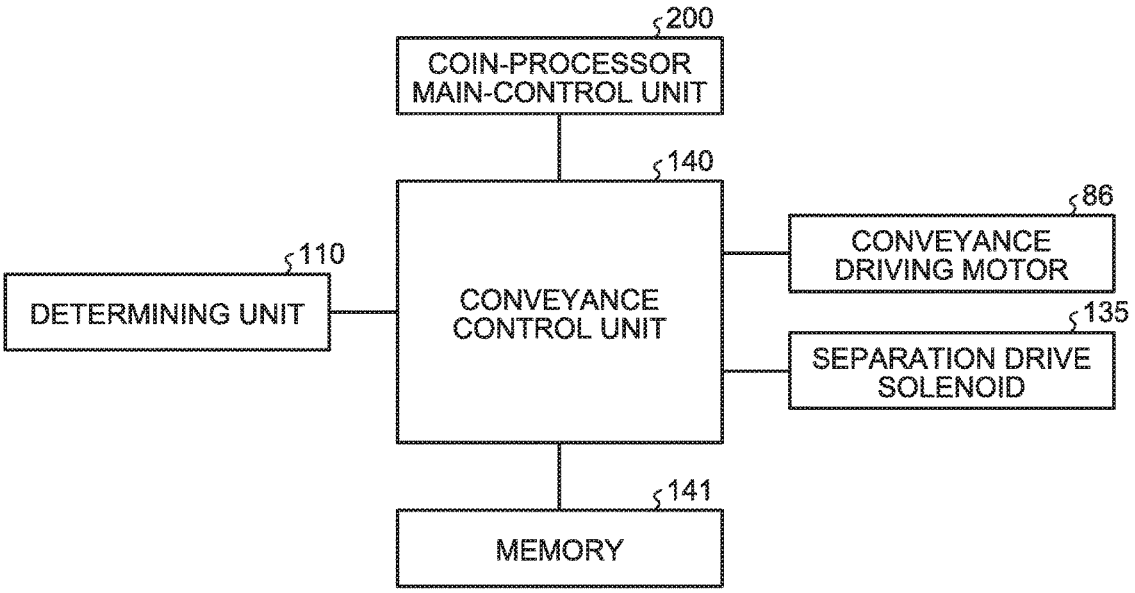
FIG. 19 is a block diagram schematically showing a control system characteristic to the coin conveying device shown in FIG. 16 and FIG. 17.

FIG. 16 is a perspective view showing the coin conveying device 10*b* shown in FIG. 1 and FIG. 2, and FIG. 17 is a perspective view showing a part of components of the coin conveying device 10*b* shown in FIG. 16 in a simplified manner. FIG. 18 is a plan view showing a part of components of the coin conveying device 10*b* shown in FIG. 16 in a simplified manner, and FIG. 19 is a block diagram schematically showing a control system characteristic to the coin conveying device 10*b* shown in FIG. 16 and FIG. 17.

The coin conveying device 10*b* exemplified herein conveys coins for which authenticity and denominations have been discriminated by the coin verification device 10*a*, and determines the denominations of the coins while conveying, and sends the coins to a coin storage unit 5 (refer to FIG. 1 and FIG. 2) separating the coins according to denominations. The coin storage unit 5 is to store coins separated by the coin conveying device 10*b* according to denominations, and feeds out, when a payout instruction is given, a corresponding coin to the payout unit 4 to eject to the outside through the payout unit 4.

The coin conveying device 10*b* includes a rail portion 70, a conveying portion 80, a reverse roller 90, a control unit 100 (refer to FIG. 27), a determining unit 110, a returning unit 120, a separating unit 130, and a conveyance control unit (controller) 140.

Figure 20:
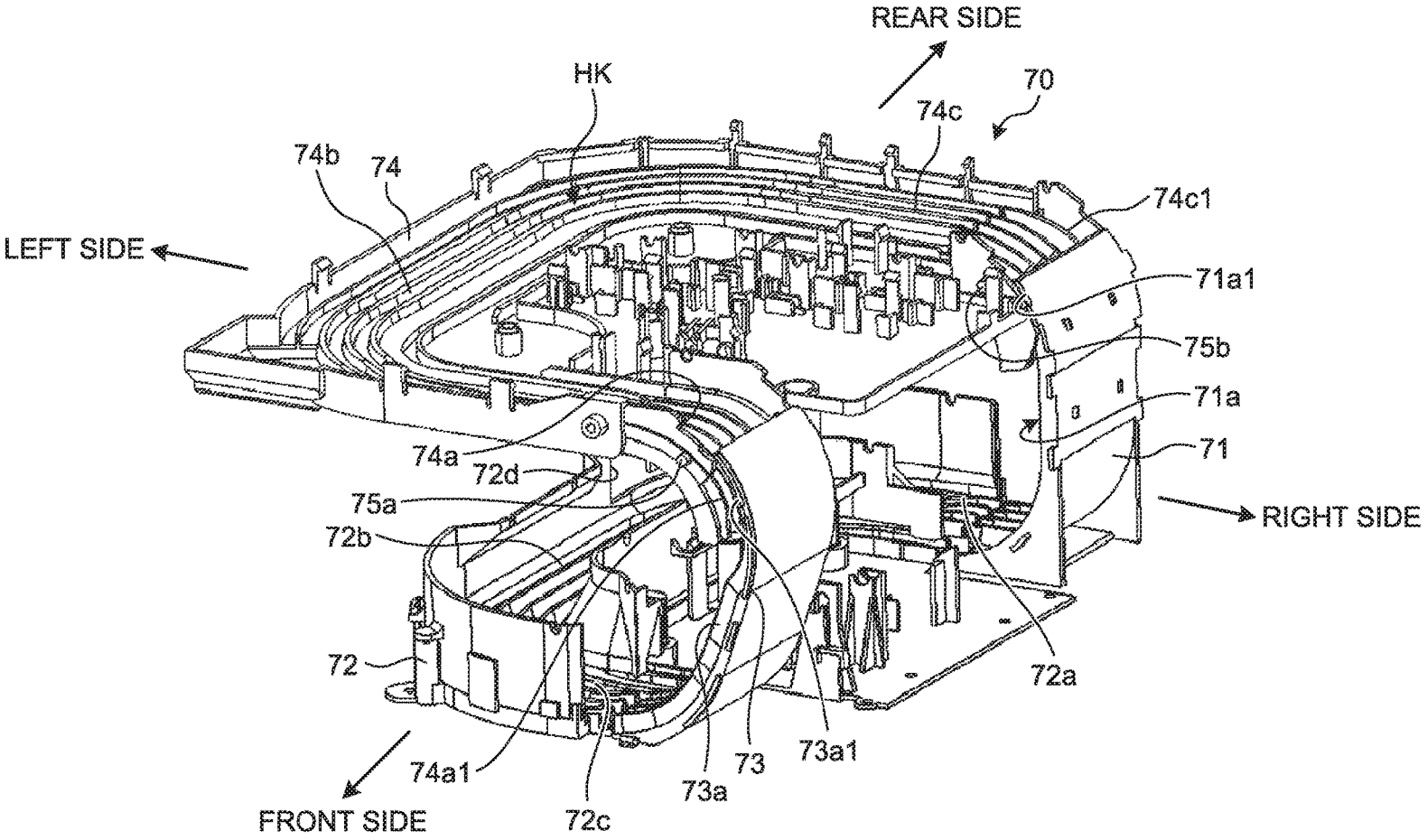
FIG. 20 is a perspective view showing a rail portion shown in FIG. 16 and FIG. 17.

The rail portion 70 includes a first rail-forming member 71, a second rail-forming member 72, a third rail-forming member 73, and a fourth rail-forming member 74 as shown in FIG. 20 also.

The first rail-forming member 71 forms a conveyance path HK at a rear right part of the coin conveying device 10*b*. This first rail-forming member 71 has a curved lower extension 71*a* that curves downward so as to protrude toward the rear side. That is, the first rail-forming member 71 structures a falling part that extends in a state curved downward.

The second rail-forming member 72 forms the conveyance path HK at a lower part of the coin conveying device 10*b*. This second rail-forming member 72 has a first left extension 72*a*, a front extension 72*b*, and a first right extension 72*c*.

The first left extension 72*a* is a portion that is connected to the curved lower extension 71*a* in the first rail-forming member 71, and that extends leftward. The front extension 72*b* is a portion that extends frontward from an end of extension of the first left extension 72*a*. The first right extension 72*c* is a portion that extends rightward from an end of extension of the front extension 72*b*. In the second rail-forming member 72, a slot 72*d* to which a coin discriminated as a genuine coin by the coin verification device 10*a* is put in is formed.

The third rail-forming member 73 forms the conveyance path HK at a front right part of the coin conveying device 10*b*. This third rail-forming member 73 is connected to the first right extension 72*c* of the second rail-forming member 72, and has a curved upper extension 73*a* that curves upward so as to protrude toward the rear side. That is, the third rail-forming member 73 structures a rising part that extends in a state curved upward.

The fourth rail-forming member 74 forms an upper part of the conveyance path HK of the coin conveying device 10*b*. This fourth rail-forming member 74 has a second left extension 74*a*, a rear extension 74*b*, and a second right extension 74*c*.

The second left extension 74*a* is a portion that extends leftward. This second left extension 74*a* is curved in such a manner that a right end portion 74*a*1 faces an upper end portion 73*a*1 of the curved upper extension 73*a* of the third rail-forming member 73. The rear extension 74*b* is a portion that extends toward the rear side from an end of extension of the second left extension 74*a*. The second right extension 74*c* is a portion that extends rightward from an end of extension of the rear extension 74*b*. This second right extension 74*c* is curved in such a manner that a right end portion 74*c*1 faces an upper end portion 71*a*1 of the curved lower extension 71*a* of the first rail-forming member 71.

As described, the rail portion 70 structures the endless conveyance path HK with the first rail-forming member 71, the second rail-forming member 72, the third rail-forming member 73, and the fourth rail-forming member 74 connected sequentially.

Figure 21:
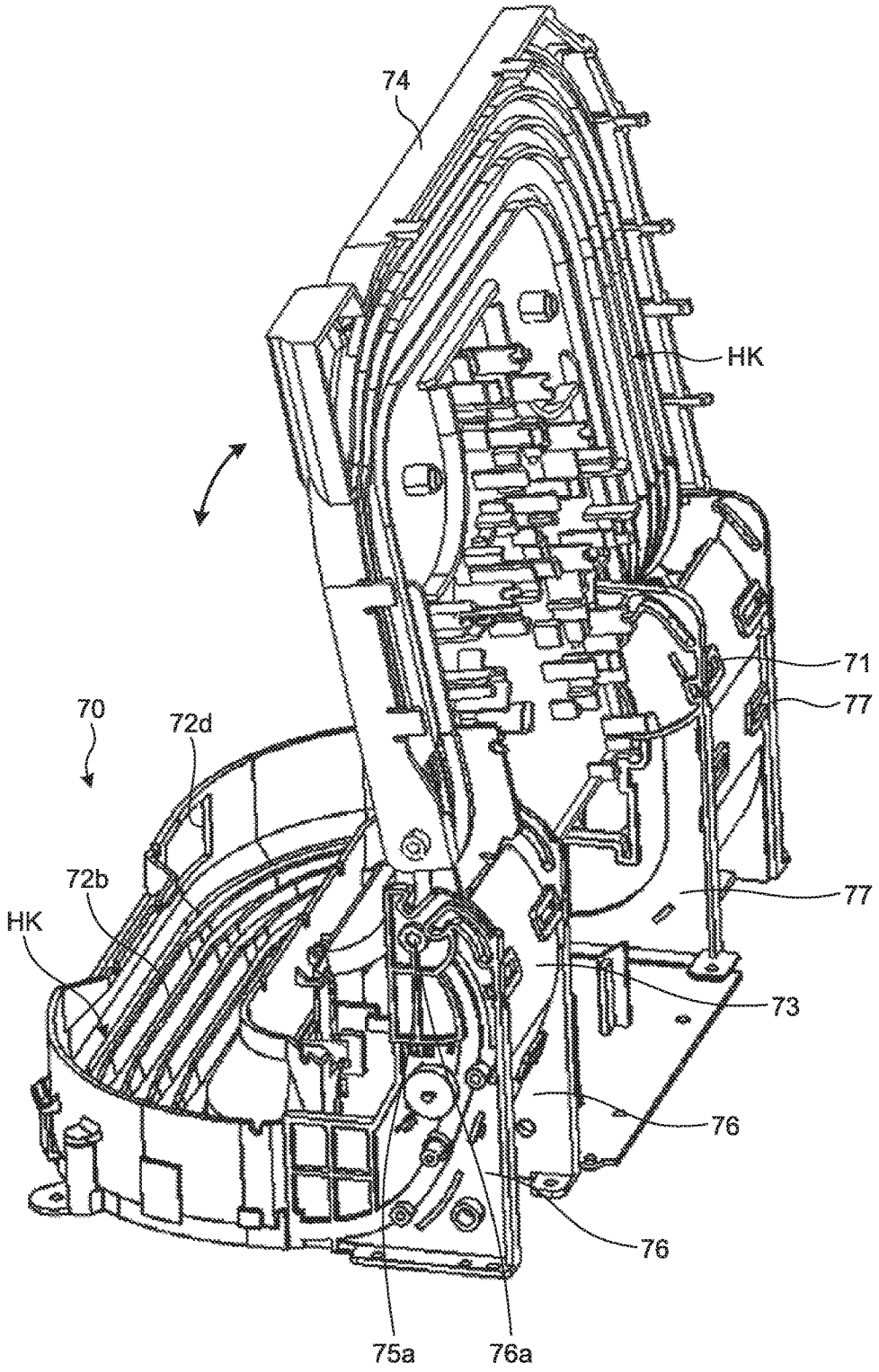
FIG. 21 is a perspective view showing the rail portion shown in FIG. 16 and FIG. 17.

Moreover, in the above rail portion 70, the fourth rail-forming member 74 is inserted through a first support hole 76*a* (refer to FIG. 21) of a first support plate 76 that supports in such a manner that a first protrusion 75*a* formed at the right end portion 74*a*1 of the second left extension 74*a* sandwiches the third rail-forming member 73 from front and rear, and is inserted through a second support hole (not shown) of a second support plate 77 that supports in such a manner that a second protrusion 75*b* formed at a right end portion 74*c*1 of the second right extension 74*c* sandwiches the first rail-forming member 71 from front and rear. The first protrusion 75*a* and the second protrusion 75*b* are provided such that center axes thereof are coaxial with each other. Therefore, the fourth rail-forming member 74 is swingable by, for example, 60° about the center axes of the first protrusion 75*a* and the second protrusion 75*b*. That is, the fourth rail-forming member 74 can swing in an upward and downward direction about the center axes of the first protrusion 75*a* and the second protrusion 75*b* as shown in FIG. 21.

Figure 22:
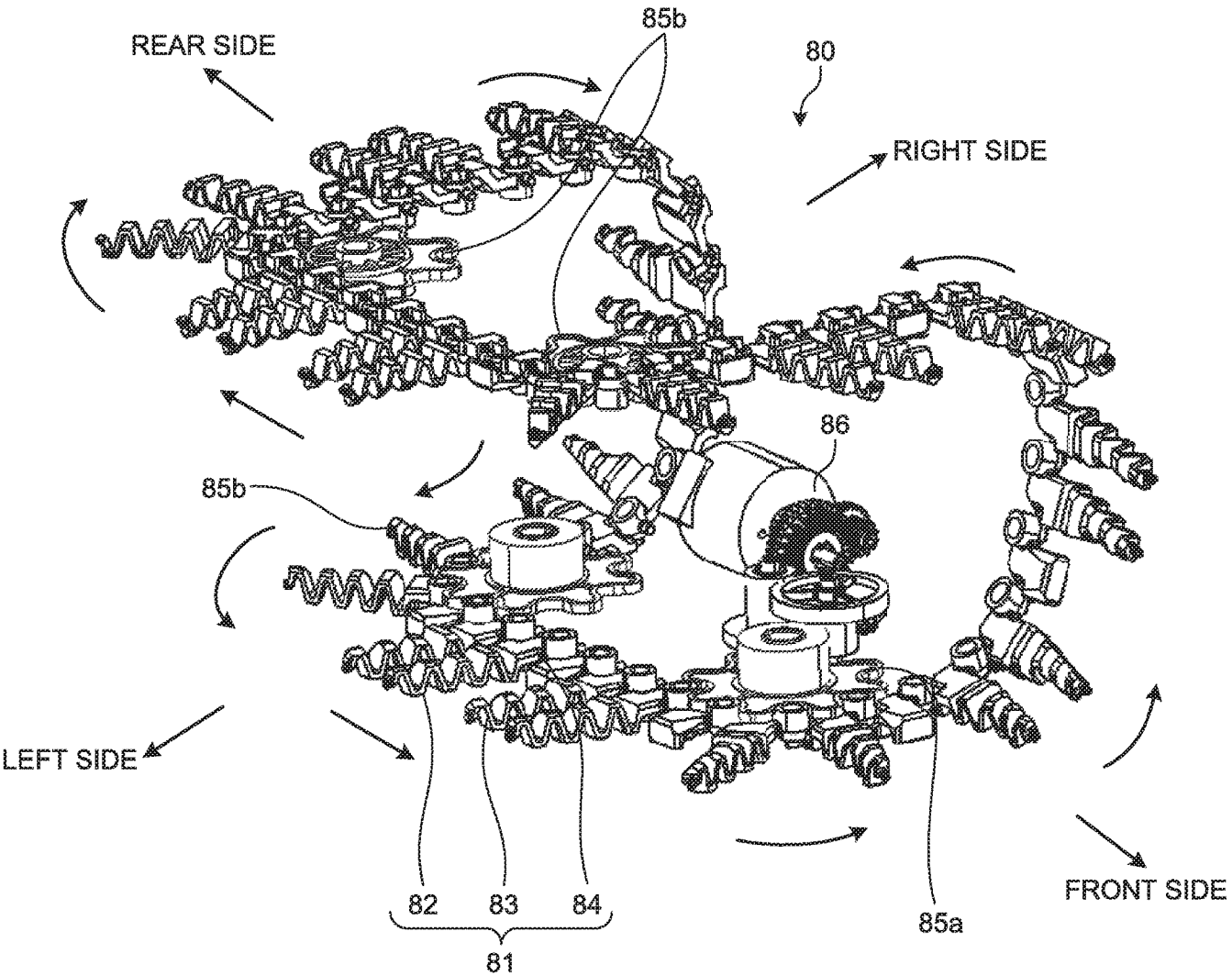
FIG. 22 is a perspective view showing the conveying portion constituting the coin conveying device shown in FIG. 16.
Figure 23:
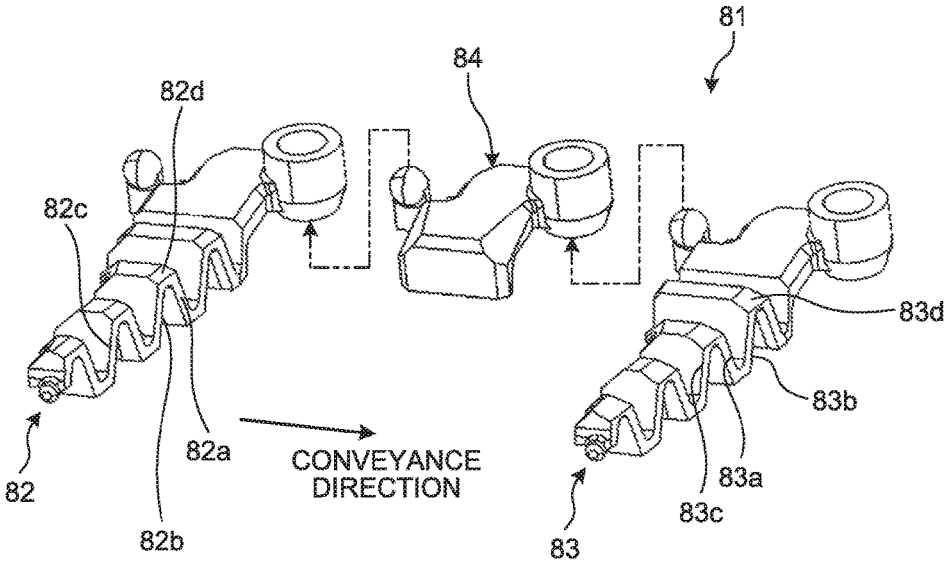
FIG. 23 is an explanatory diagram showing components of a holder unit shown in FIG. 22 in an exploded manner.

FIG. 22 is a perspective view showing the conveying portion 80 constituting the coin conveying device 10*b* shown in FIG. 16. As shown in FIG. 22, the conveying portion 80 is structured with multiple holders 81 connected endlessly.

The conveying portion 80 is engaged with a driving conveyance pulley 85*a* and plural driven conveyance pulleys 85*b* (three in the illustrated example) at some parts thereof, and is displaced along the conveyance path HK as the conveying portion 80 is rotated by a driving force of a conveyance driving motor 86.

The conveyance driving motor 86 is activated when a drive command is given by the conveyance control unit 140 and is capable of driving in forward and reverse rotation. When the conveyance driving motor 86 drives in a forward rotation direction, the respective holders 81 of the conveying portion 80 are displaced relative to rail portion 70 to move in one direction in order of the first rail-forming member 71, the second rail-forming member 72, the third rail-forming member 73, and the fourth rail-forming member 74.

On the other hand, when the conveyance driving motor 86 drives in a reverse rotation direction, the respective holders 81 of the conveying portion 80 are displaced relative to the rail portion 70 to move in the opposite direction in order of the fourth rail-forming member 74, the third rail-forming member 73, the second rail-forming member 72, and the first rail-forming member 71.

In the conveying portion 80, due to the shape of the conveyance path HK, a posture of the holder 81 when passing through the second rail-forming member 72 and a posture of the holder 81 when passing through the fourth rail-forming member 74 are oriented vertically inverted.

The holder 81, which is a component of the conveying portion 80 described above, holds one coin each, and is structured with a holder pushing member 82 and a holder control member 83 connected by a holder connecting member 84.

The holder pushing member 82 is a stick-shaped body that extends from the inside toward the outside of the conveyance path HK. This holder pushing member 82 pushes a coin to the downstream side of the conveyance path HK as the conveying portion 80 is displaced, and is structured such that a pushing surface 82*a* facing the downstream side of the conveyance path HK is inclined gradually toward the upstream side from the inside to the outside.

Figure 24:
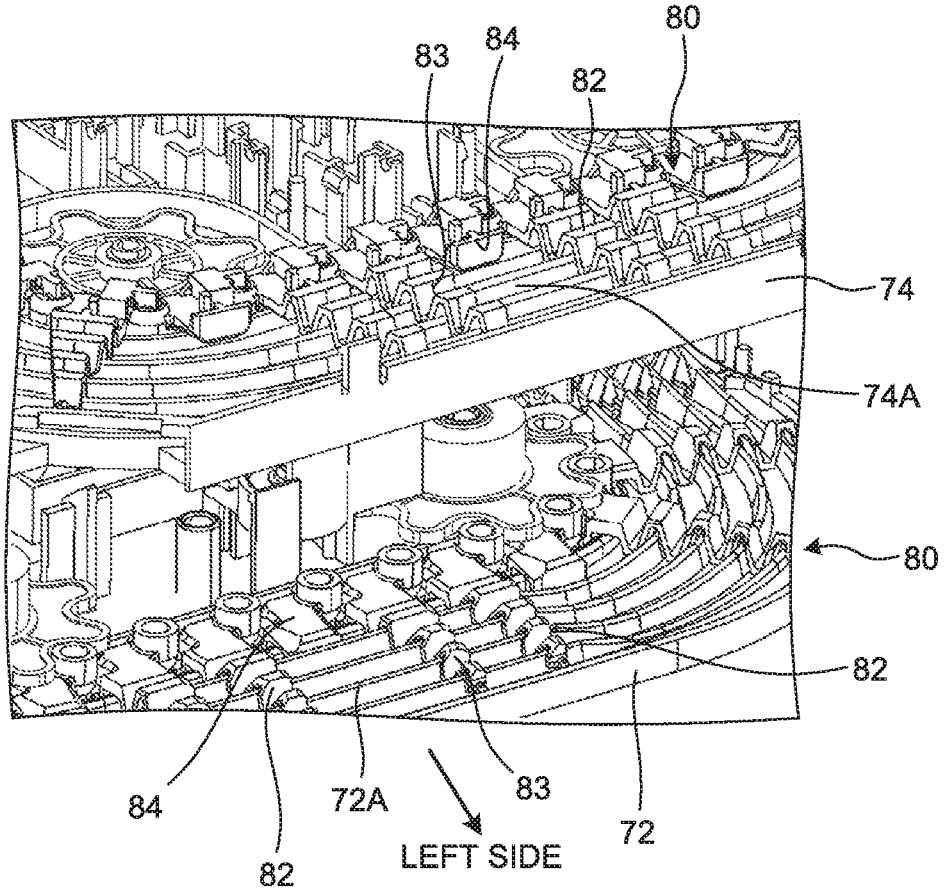
FIG. 24 is a perspective view showing an essential part of a second-rail forming member and a fourth-rail forming member in an enlarged manner.
Figure 25:
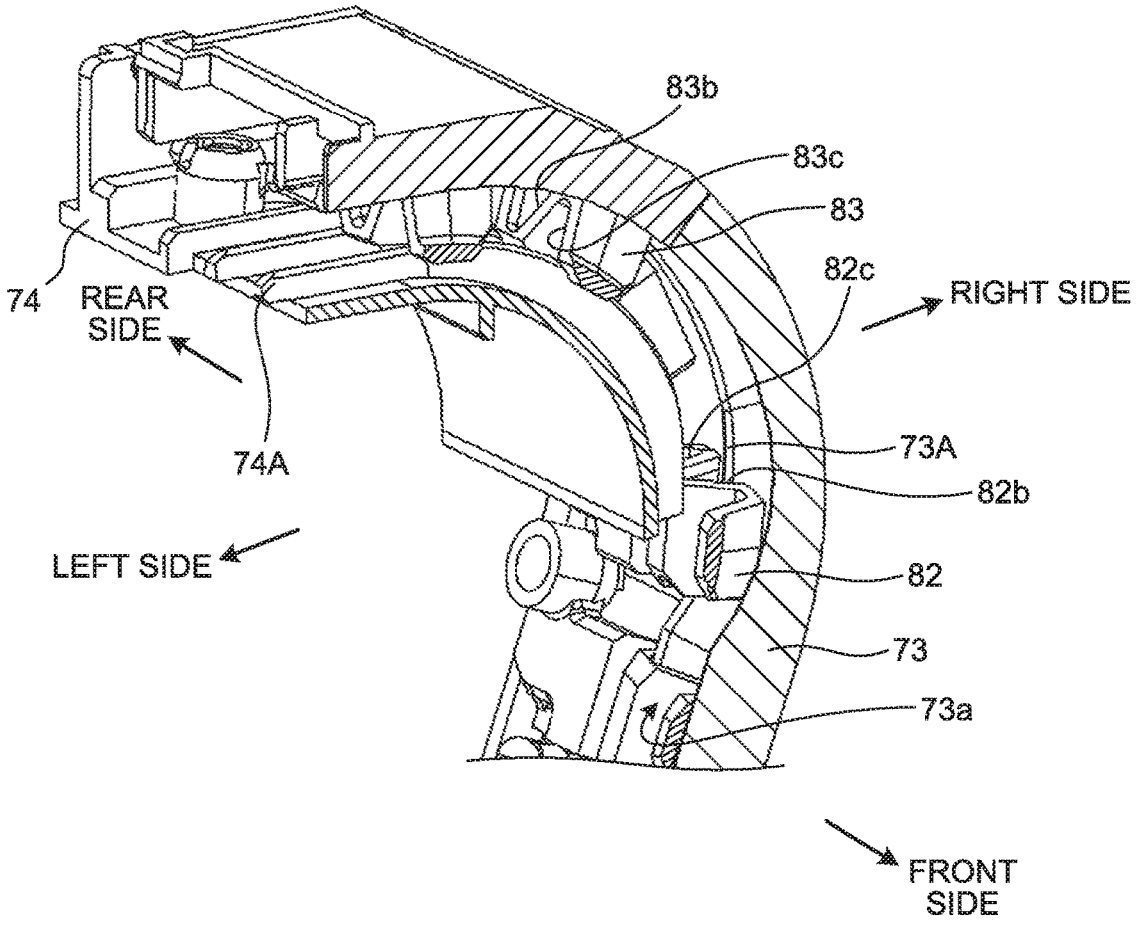
FIG. 25 is a cross-section showing a portion at which an upper end portion of a curved upper extension of a third rail-forming member faces a right end portion of a second left extension of a fourth rail-forming member in an enlarged manner.
Figure 26:
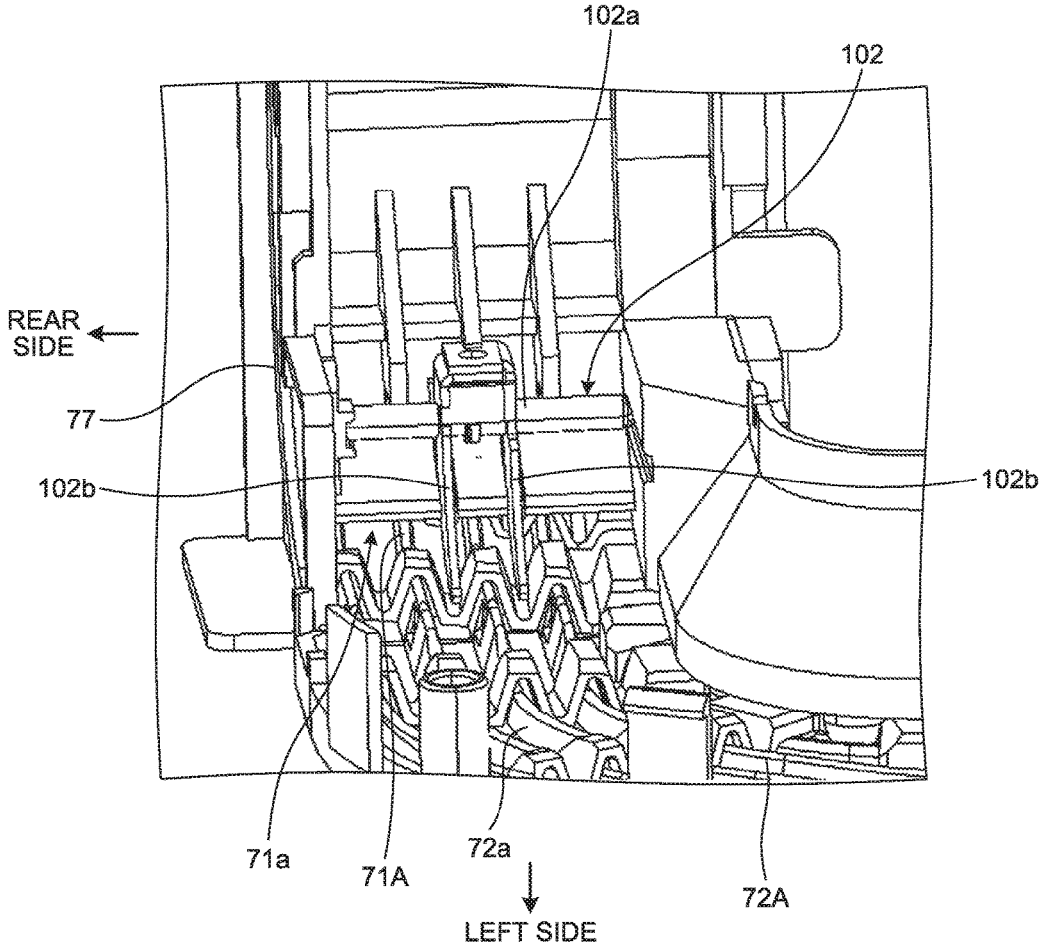
FIG. 26 is a perspective view showing a part at which a curve lower extension of a first rail-forming member is connected to a first left extension of a second rail-forming member in an enlarged manner.

Moreover, as shown in FIG. 24 to FIG. 26, the holder pushing member 82 has a first concave portion 82*b* that allows a rail convex portion 71A formed in the first rail-forming member 71, a rail convex portion 72A formed in the second rail-forming member 72, and a rail convex portion 73A formed in the third rail-forming member 73 to enter, and a second concave portion 82*c* that allows a rail convex portion 74A formed in the fourth rail-forming member 74 to enter. On the pushing surface 82*a* at a bottom portion of the first concave portion 82*b*, an inclined surface 82*d* is formed.

The holder control member 83 has a shape similar to the holder pushing member 82, and is a stick-shaped body that extends from the inside toward the outside of the conveyance path HK. This holder control member 83 is connected to the holder pushing member 82 at an inside thereof through the holder connecting member 84, and controls a position of a coin pushed by the holder pushing member 82 not to be apart from the holder pushing member 82 more than necessary. The holder control member 83 is connected, at the inside thereof, to the holder pushing member 82 that constitutes the holder 81 positioned on the downstream side of this holder 81.

The holder control member 83 is structured such that a downstream surface 83*a* facing the downstream side of the conveyance path HK is inclined gradually toward the upstream side from the inside to the outside. This holder control member 83 has a third concave portion 83*b* that allows the rail convex portion 71A formed in the first rail-forming member 71, the rail convex portion 72A formed in the second rail-forming member 72, and the rail convex portion 73A formed in the third rail-forming member 73 to enter, and a fourth concave portion 83*c* that allows the rail convex portion 74A formed in the fourth rail-forming member 74 to enter. On the downstream surface 83*a* at a bottom portion of the third concave portion 83*b*, an inclined surface 83*d* is formed.

As described above, the upper end portion 73*a*1 of the curved upper extension 73*a* of the third rail-forming member 73 and the right end portion 74*a*1 of the second left extension 74*a* of the fourth rail-forming member 74 face each other. Therefore, as shown in FIG. 25, when passing through the facing portion, the holder 81 is in a state in which the rail convex portion 73A of the third rail-forming member 73 enters the first concave portion 82*b* of the holder pushing member 82, and the rail convex portion 74A of the fourth rail-forming member 74 enters the second concave portion 82*c* of the holder pushing member 82, and similarly, in a state in which the rail convex portion 73A enters in the third concave portion 83*b* of the holder control member 83, and the rail convex portion 74A of the fourth rail-forming member 74 enters the fourth concave portion 83*c* of the holder control member 83.

Furthermore, as described above, the upper end portion 71*a*1 of the curved lower extension 71*a* of the first rail-forming member 71 and the right end portion 74*c*1 of the second right extension 74*c* of the fourth rail-forming member 74 face each other. Therefore, although not explicitly shown in the drawings, when passing through the facing portion, the holder 81 is in a state in which the rail convex portion 71A of the first rail-forming member 71 enters the first concave portion 82*b* of the holder pushing member 82, and the rail convex portion 74A of the fourth rail-forming member 74 enters the second concave portion 82*c* of the holder pushing member 82, and similarly, in a state in which the rail convex portion 71A of the first rail-forming member 71 enters the third concave portion 83*b* of the holder control member 83, and the rail convex portion 74A of the fourth rail-forming member 74 enters the fourth concave portion 83*c* of the holder control member 83.

The reverse roller 90 is rotatably provided to the first support plate 76 so as to face the third rail-forming member 73. This reverse roller 90 is linked to the conveyance driving motor 86 through a conveyance linkage unit 91, and rotates about an axis of itself by a driving force of the conveyance driving motor 86.

Figure 27:
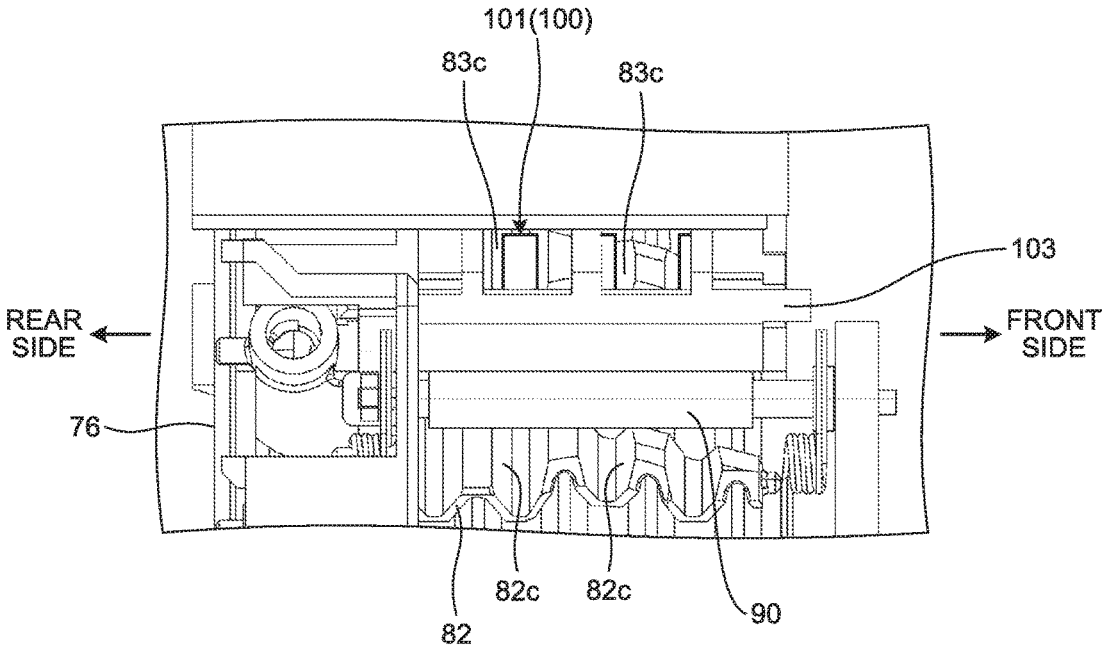
FIG. 27 is a left side view showing an upper portion of a reverse roller in an enlarged manner.
Figure 28:
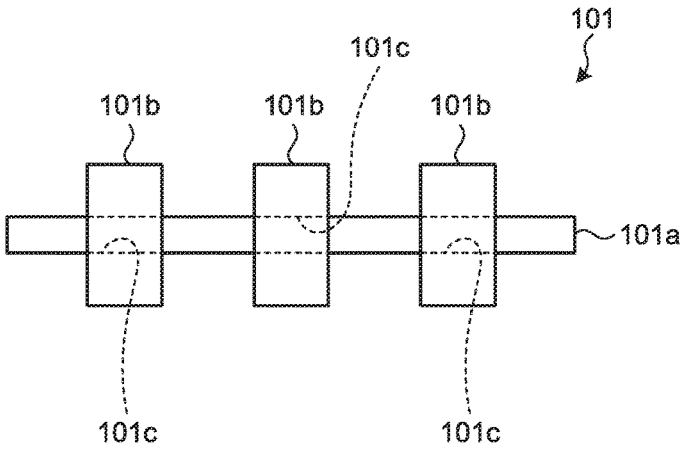
FIG. 28 is a schematic diagram of a posture control member shown in FIG. 27.
Figure 29:
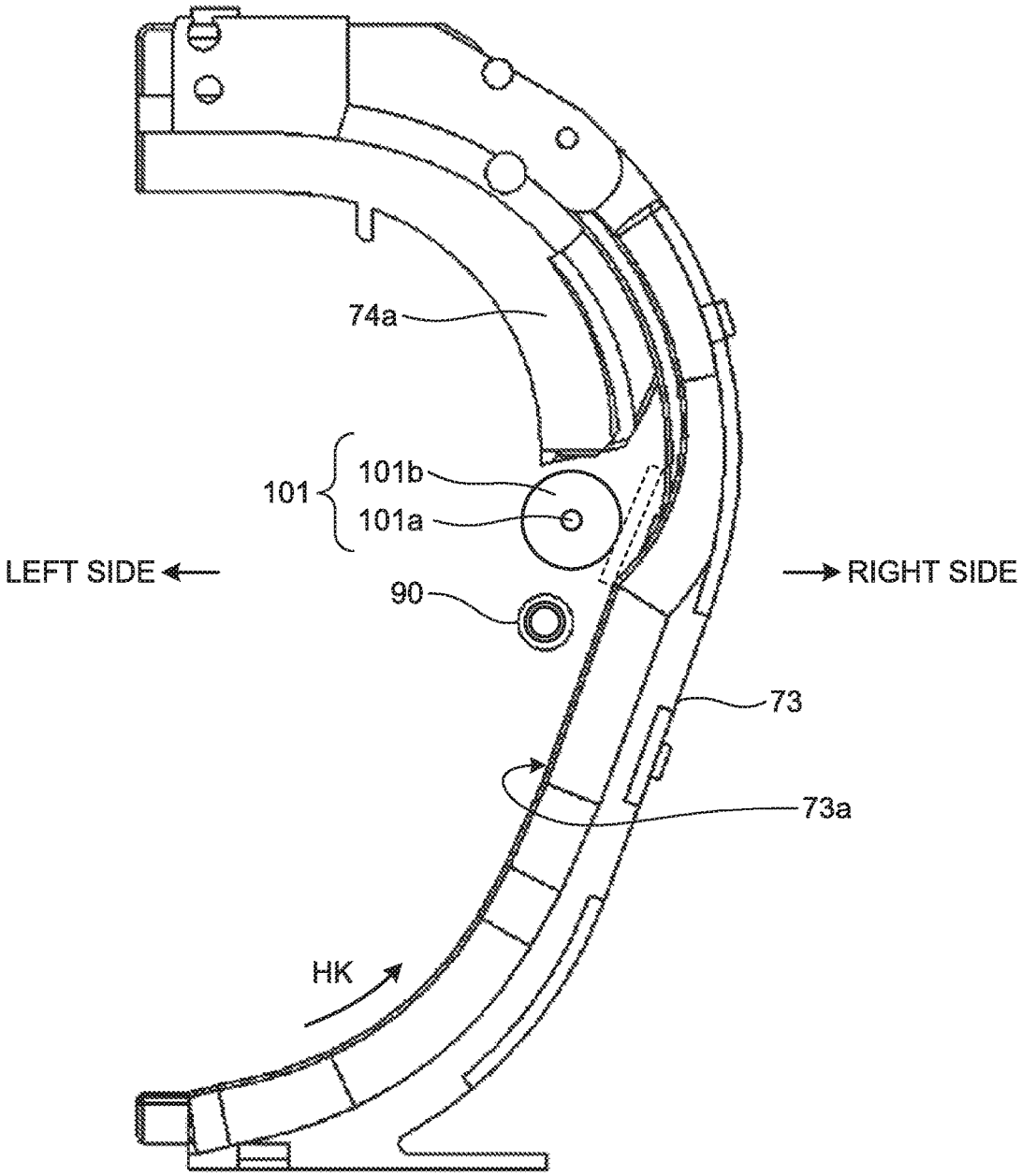
FIG. 29 is a front view of an essential part of the third rail-forming member.

The control unit 100 includes a posture control member 101 and a passage control member 102. The posture control member 101 is attached to a posture-control supporting unit 103 mounted on the first support plate 76 so as to face the third rail-forming member 73 in an area above the reverse roller 90 as shown in FIG. 27. The posture control member 101 has a posture control axis 101*a* and multiple posture-control acting portions 101*b* as shown in FIG. 28. The posture control axis 101*a* is a cylindrical member that extends along the front and rear direction, and is supported by the posture-control supporting unit 103 at both end portions. The posture-control acting portion 101*b* is a disc-shaped member having a wider diameter than the posture control axis 101*a*, and has a through hole 101*c* at a central part thereof. These posture-control acting portions 101*b* are provided rotatably about the posture control axis 101*a* by such an arrangement that the posture control axis 101*a* pierces through the through holes 101*c* in a state in which the posture-control acting portions 101*b* are positioned apart from each other along the direction of extension of the posture control axis 101*a*. The thickness in the front and rear direction of the posture-control acting portion 101*b* is in a size allowing the insertion into the second concave portion 82*c* of the holder pushing member 82, the fourth concave portion 83*c* of the holder control member 83.

The posture control member 101 controls the posture of a coin that is conveyed upward at the curved upper extension 73*a* of the third rail-forming member 73 by pushing the coin toward the third rail-forming member 73 (rail portion 70).

Figure 30:
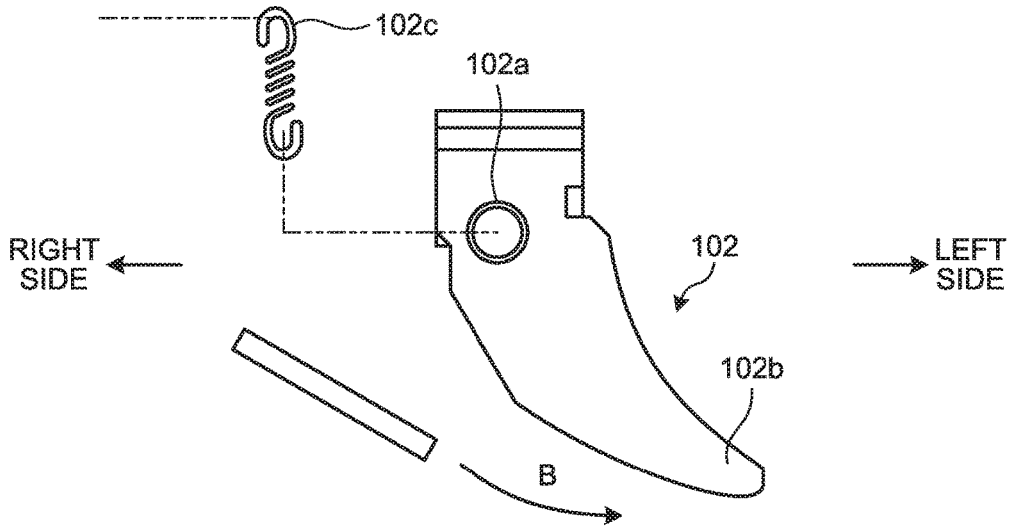
FIG. 30 is a schematic diagram of a passage control member shown in FIG. 26.

The passage control member 102 is arranged at the second support plate 77 so as to face a part at which the curved lower extension 71*a* of the first rail-forming member 71 and the first left extension 72*a* of the second rail-forming member 72 are connected to each other as shown in FIG. 26. This passage control member 102 is structured with a passage control axis 102*a* and a passage-control acting portion 102*b* formed integrally as shown in FIG. 30.

The passage control axis 102*a* is a cylindrical member that extends along the front and rear direction, and is swingably supported about a center axis of the passage control axis 102*a* by the second support plate 77 at both end portions. Two pieces of the passage-control acting portions 102*b* are provided in a front-and-rear pair, and are positioned in a state separated from each other, and extends from a center region portion of the passage control axis 102*a* outward in a direction of diameter of the passage control axis 102*a*.

The passage control member 102 is pushed rightward by a passage control spring 102*c*, which is a pushing means, and an end portion of the passage-control acting portion 102*b* has entered a passage area B of a conveyed coin.

Figure 31:
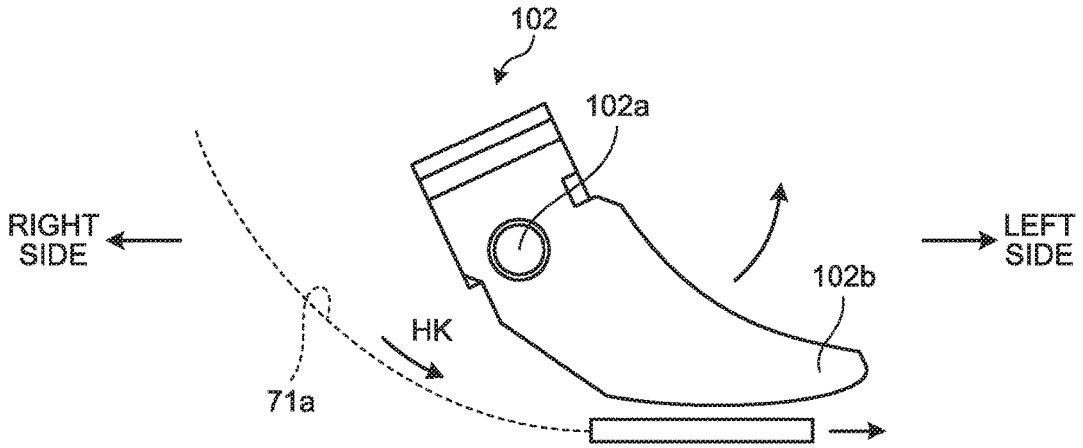
FIG. 31 is a schematic diagram of the passage control member shown in FIG. 26.

As shown in FIG. 31, when the conveying portion 80 is displaced in one direction by the conveyance driving motor 86 driving in the forward rotation direction, the passage control member 102 abuts on the coin that is being conveyed downward in the first rail-forming member 71 to swing leftward against the pushing force of the passage control spring 102*c*. As a result, the passage control member 102 allows passage of the coin.

Figure 32:
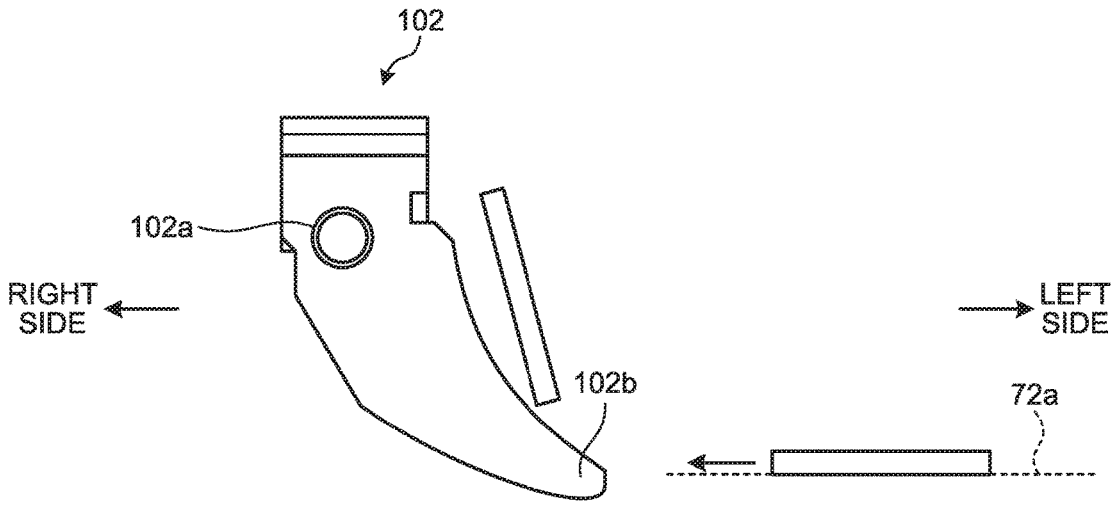
FIG. 32 is a schematic diagram of the passage control member shown in FIG. 26.

On the other hand, when the conveying portion 80 is displaced in a reverse direction by the conveyance driving motor 86 driving in the reverse rotation direction, the passage control member 102 separate the coin that is being conveyed in the reverse direction by the conveying portion 80 in the second rail-forming member 72 from the holder 81 to prevent the coin from passing through the curved lower extension 71*a* of the first rail-forming member 71 as shown in FIG. 32.

The determining unit 110 is provided at the fourth rail-forming member 74. This determining unit 110 determines denominations of coins that are conveyed pushed by the holder pushing member 82 of the holder 81 in a predetermined determination area in the fourth rail-forming member 74. A determination result by the determining unit 110 is output to the conveyance control unit 140 as a determination signal.

The returning unit 120 is arranged on a downstream side to the determining unit 110 (determination area) in the conveyance path HK that is formed by the fourth rail-forming member 74, and includes a return opening 121 and a return gate 122.

The return opening 121 is an opening in size that allows passage of coins of all kinds of denominations conveyed by the conveying portion 80, and is communicated to the payout unit 4.

The return gate 122 closes the return opening 121 in a normal state, but opens the return opening 121 by swinging when a return command is given.

The separating unit 130 is arranged on a downstream side to the returning unit 120 in the conveyance path HK that is formed by the fourth rail-forming member 74. This separating unit 130 includes multiple separation passages 131 and separation gates 132.

The multiple separation passages 131 are openings each of which has a sufficient size to let a coin pass. The separation gates 132 correspond to the respective separation passages 131, and are arranged across the conveyance path HK that is formed by the fourth rail-forming member 74. More specifically, the separation gate 132 is structured with multiple separation-gate action pieces 132*b* attached at an end portion of a separation gate axis 132*a* in a long cylindrical shape, and is supported rotatably about a center axis of the separation gate axis 132*a*.

Figure 33:
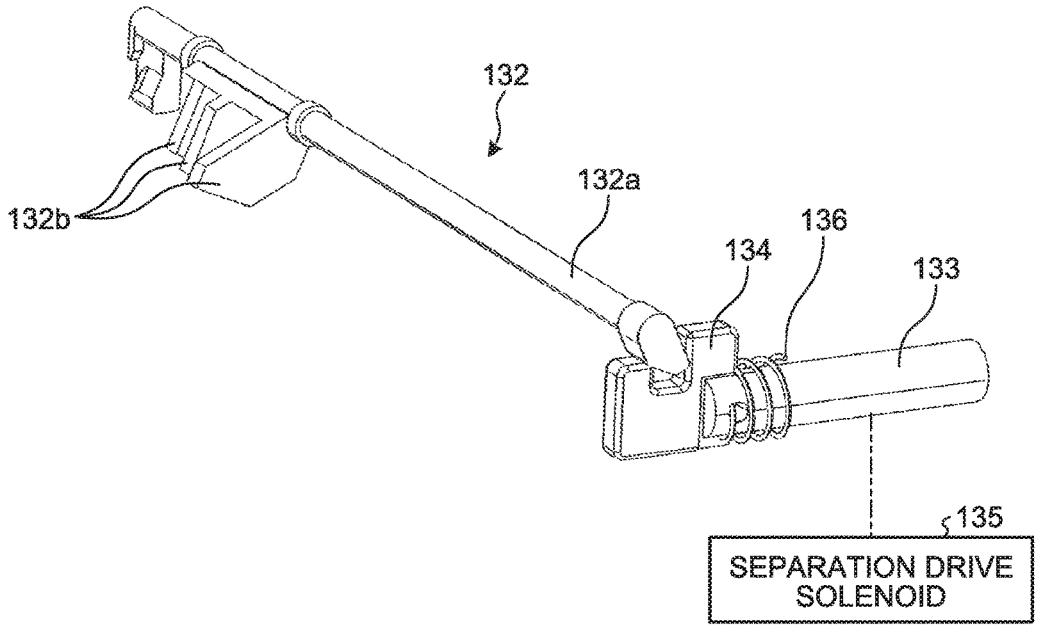
FIG. 33 is a perspective view showing a separation gate shown in FIG. 16 and FIG. 17.
Figure 34:
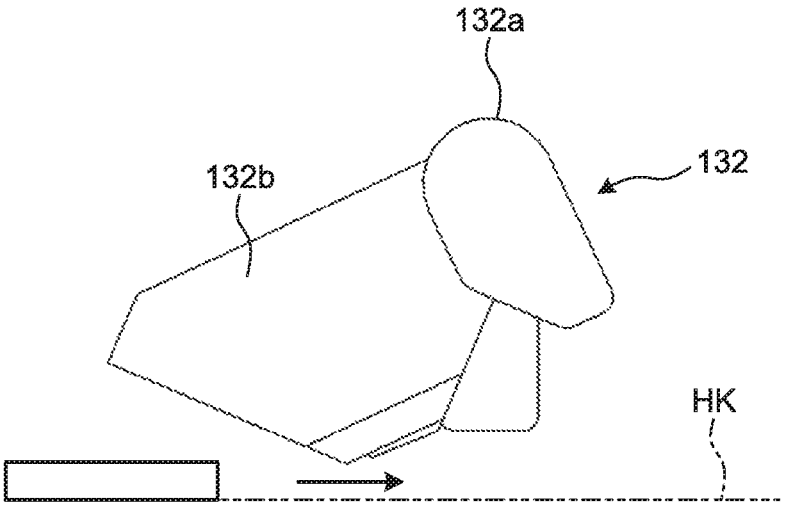
FIG. 34 is a schematic diagram showing movement of the separation gate shown in FIG. 33.

With a base portion of the separation gate axis 132*a*, as shown in FIG. 33 in an enlarged manner, an engaging claw 134 that is attached to an end portion of a plunger 133 is engaged. The plunger 133 keeps a posture in which the separation-gate action pieces 132*b* are separated from the conveyance path HK of a coin as shown in FIG. 34 by a pushing force of a spring 136 arranged in itself when a separation drive solenoid 135 is not energized.

Figure 35:
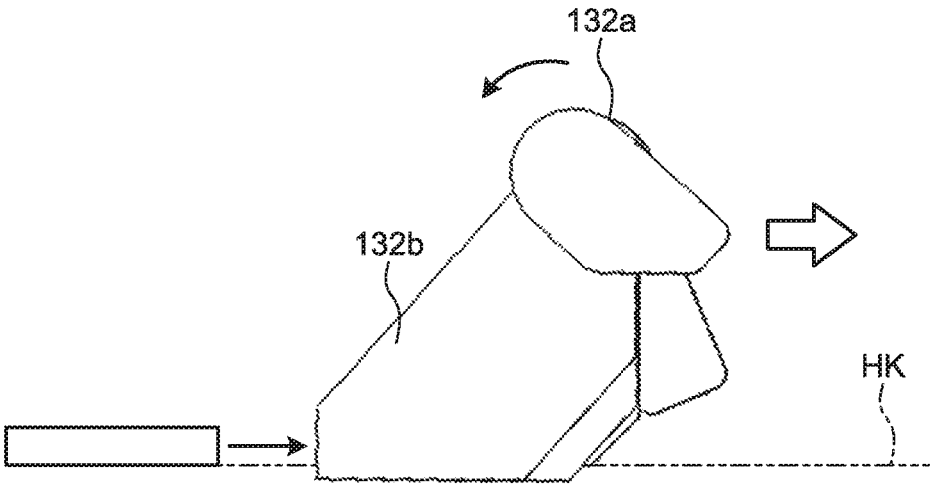
FIG. 35 is a schematic diagram showing the movement of the separation gate shown in FIG. 33.

On the other hand, when a drive command is given from the conveyance control unit 140 and the separation drive solenoid 135 is energized, the plunger 133 is drawn in by the separation drive solenoid 135, and rotates the separation gate 132 about the center axis of the separation gate axis 132*a* as shown in FIG. 35 to bring the separation-gate action pieces 132*b* into the conveyance path HK.

Figure 36:
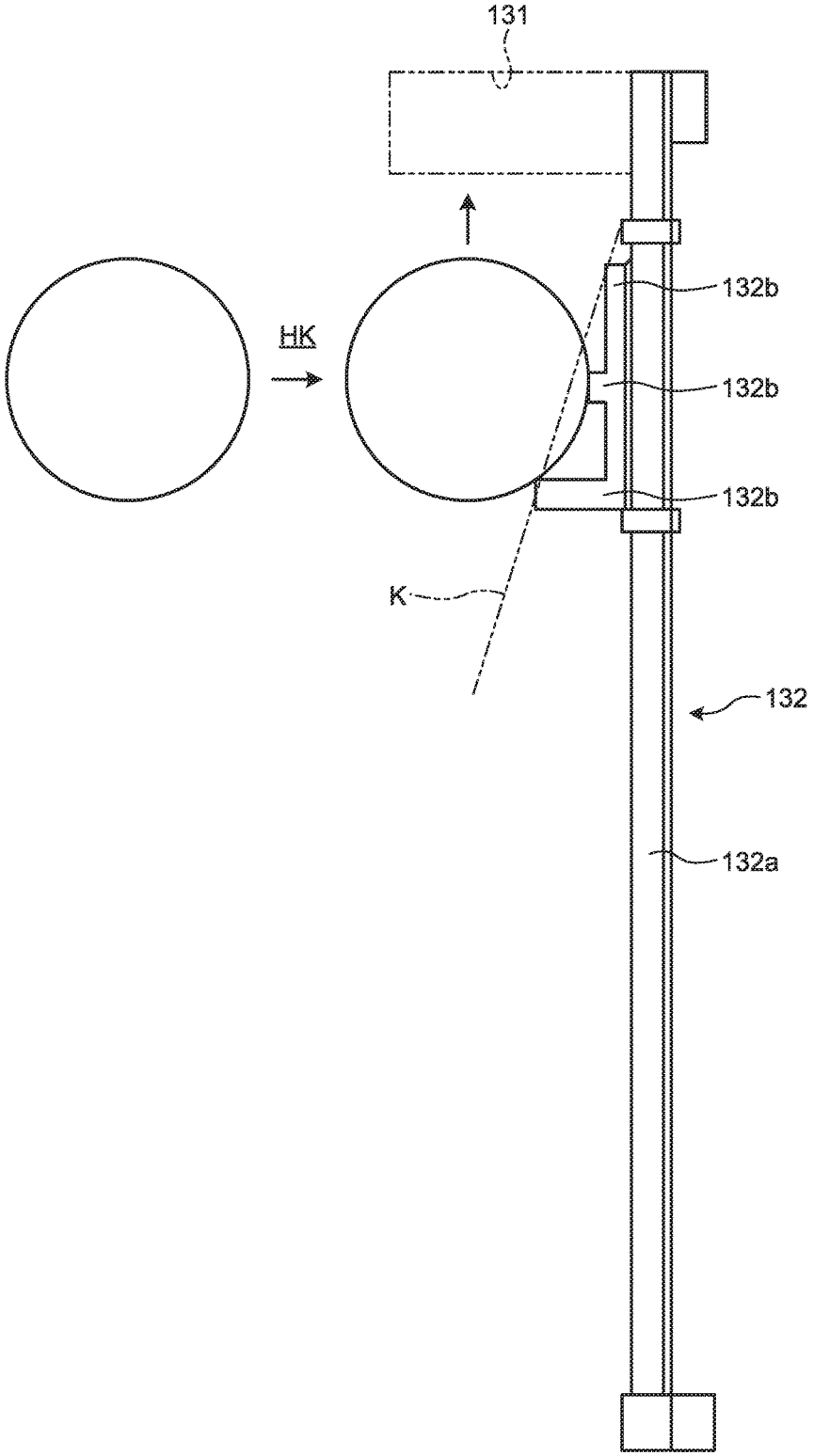
FIG. 36 is a schematic diagram showing the movement of the separation gate shown in FIG. 3 from above.

When the separation-gate action pieces 132*b* thus enter the conveyance path HK, an inclined portion K that is inclined toward the downstream side in the conveyance direction from an end portion of the separation-gate action pieces 132*b* toward the separation passage 131 is formed as shown in FIG. 36, and this inclined portion K enables to guide the coin that is being conveyed in the conveyance path HK to the predetermined separation passages 131.

The conveyance control unit 140 performs overall control of operation of the coin conveying device 10*b* according to a program and data stored in a memory 141. The conveyance control unit 140 can be implemented by, for example, causing a processing device such as a central processing unit (CPU) to execute a program, that is, by software, can be implemented by hardware such as an integrated circuit (IC), or can be implemented by combining software and hardware.

Moreover, as described above, the conveyance control unit 140 gives a drive command to the conveyance driving motor 86 to make it drive in the forward rotation direction or the reverse rotation direction, and when making the conveyance driving motor 86 to drive in the forward rotation direction, the conveyance control unit 140 performs pulse width modulation (PWM) control to approximate a predetermined conveying force.

On the other hand, when making the conveyance driving motor 86 to drive in the reverse rotation direction, the conveyance control unit 140 controls to a conveying force larger than the conveying force in the case of driving in the forward rotation direction.

That is, the conveyance control unit 140 displaces the conveying portion 80 in such a manner that a driving force for displacement in one direction is smaller than a driving force for displacement in a reverse direction.

The coin conveying device 10*b* having the configuration as described above operates as follows when a coin that has been discriminated as a genuine coin is output from the coin verification device 10*a* and a drive command is given by the coin-processor main-control unit 200 to the conveyance control unit 140.

Specifically, the conveyance control unit 140 gives a drive command for the reverse direction to the conveyance driving motor 86 to make the conveyance driving motor 86 drive in the reverse direction, and causes the conveying portion 80 to displace in the reverse direction for predetermined time. Thus, the coin put into the second rail-forming member 72 from the slot 72*d* is conveyed in the reverse direction in the second rail-forming member 72 by the conveying portion 80.

As the passage control member 102 separates the coin, which is being conveyed in the reverse direction by the conveying portion 80, from the holder 81 to prevent the coin from passing through the curved lower extension 71*a* of the first rail-forming member 71, the coin put into the second rail-forming member 72 from the slot 72*d* can be accumulated in the second rail-forming member 72.

When the predetermined time passes, the conveyance control unit 140 gives a drive command for the forward direction to the conveyance driving motor 86 to make the conveyance driving motor 86 drive in the forward direction, and causes the conveying portion 80 to displace in one direction. Thus, the coin accumulated in the second rail-forming member 72 can be conveyed in one direction along the conveyance path HK.

The holder 81 of the conveying portion 80 has the inclined surface 82*d* formed on the pushing surface 82*a* at the bottom portion of the first concave portion 82*b* in the holder pushing member 82. Therefore, as the holder 81 is displaced in a state in which the rail convex portion 73A of the third rail-forming member 73 enters the first concave portion 82*b* when passing the curved upper extension 73*a* of the third rail-forming member 73, the inclined surface 82*d* is to be at a position separated from the rail.

Figure 37:
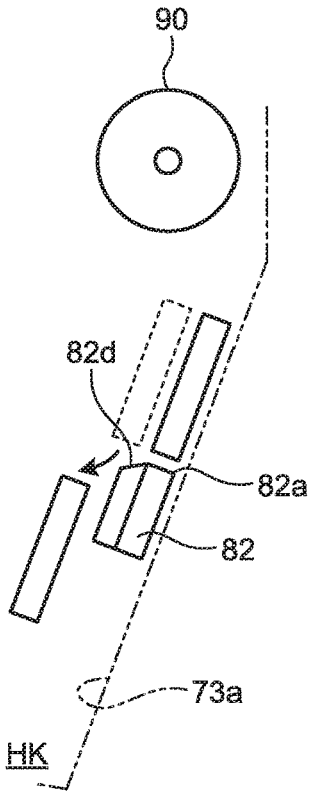
FIG. 37 is an explanatory diagram showing an action of a holder pushing member at the third rail-forming member.

Therefore, even when two pieces of coins overlapped with each other are being pushed by the holder pushing member 82 to be conveyed in an area below the reverse roller 90, as shown in FIG. 37, the overlapped coin can be separated from the holder pushing member 82 by using the inclined surface 82*d*. Thus, it is possible to suppress occurrence of a conveyance jam or the like caused by two pieces of coins got stuck between the reverse roller 90 and the conveying portion 80.

Furthermore, in an area above the reverse roller 90, as the posture control member 101 pushes a coin that is being conveyed upward at the curved upper extension 73*a* of the third rail-forming member 73 against the third rail-forming member 73 (rail portion 70) and thereby controls the posture of the coin, it is possible to avoid the coin from being derailed while passing the curved upper extension 73*a*.

Moreover, the upper end portion 73*a*1 of the curved upper extension 73*a* of the third rail-forming member 73 and the right end portion 74*a*1 of the second left extension 74*a* of the fourth rail-forming member 74 face each other, and when passing through the facing portion, the holder 81 is in a state in which the rail convex portion 73A of the third rail-forming member 73 enters the first concave portion 82*b* of the holder pushing member 82, and the rail convex portion 74A of the fourth rail-forming member 74 enters the second concave portion 82*c* of the holder pushing member 82. Therefore, a coin that is pushed by the holder pushing member 82 is conveyed also in a state of being sandwiched between the upper end portion 73*a*1 of the curved upper extension 73*a* and the right end portion 74*a*1 of the second left extension 74*a*, the coin is not likely to be derailed from the conveyance path HK.

As described, in the holder 81 passed through the third rail-forming member 73, one piece of coin is held. As the pushing surface 82*a* of the holder pushing member 82 that constitutes each of the holders 81 in the conveying portion 80 is structured in an inclined manner, it is possible to convey a coin stably, keeping it on an outer side in the conveyance path HK.

Figure 38:
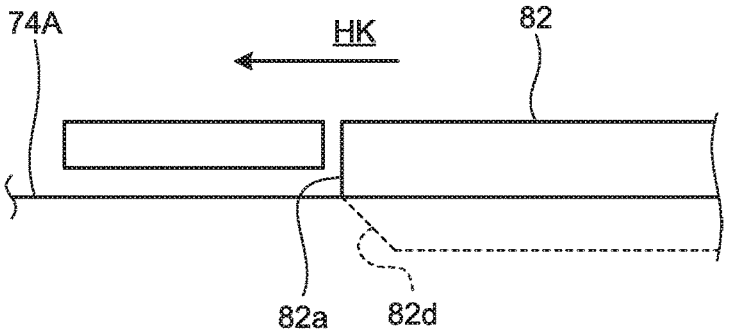
FIG. 38 is an explanatory diagram showing an action of the holder pushing member at the fourth rail-forming member.

As described above, in the conveying portion 80, the posture of the holder 81 when passing through the second rail-forming member 72 and the posture of the holder 81 when passing through the fourth rail-forming member 74 are oriented vertically inverted. Therefore, when the holder 81 is displaced in a state in which the rail convex portion 74A of the fourth rail-forming member 74 enters the second concave portion 82*c*, as shown in FIG. 38, the inclined surface 82*d* is positioned below the upper end portion of the rail convex portion 74A, and the holder pushing member 82 pushes a coin certainly and enables stable conveyance thereof.

When the denomination of a coin that passes the determination area is determined by the determining unit 110, the conveyance control unit 140 gives a drive command to the corresponding separation drive solenoid 135 according to the determination result to energize the separation drive solenoid 135. As a result, the corresponding separate gate 132 is caused to rotate about the center axis of the separation gate axis 132*a*, to bring the separation-gate action pieces 132*b* into the conveyance path HK. The inclined portion K that is formed by the separation-gate action pieces 132*b* guides the coin to the corresponding separation passage 131, and thereby store the coin in the coin storage unit 5.

When the denomination of a coin is not determined by the determining unit 110, the conveyance control unit 140 does not give a drive command to any of the separation drive solenoids 135. In this case, all the separation gates 132 are in a state in which the separation-gate action pieces 132*b* are separated from the conveyance path HK. Therefore, the coin that has passed the fourth rail-forming member 74 proceeds straight to the first rail-forming member 71 and then to the second rail-forming member 72, and repeats the passage in the conveyance path HK described above, to be determined again by the determining unit 110.

When all of coins that have been conveyed in the conveyance path HK are thus stored in the coin storage unit 5 according to denominations within predetermined operation time, the conveyance control unit 140 gives a drive stop command to the conveyance driving motor 86 to stop driving of the conveyance driving motor 86, and thereafter, outputs a signal indicating that conveyance of the coins are completed to the coin-processor main-control unit 200.

On the other hand, when the above operation time has passed with a coin remaining in the conveyance path HK, the conveyance control unit 140 gives a return command to the return gate 122 to open the return opening 121, and guides the coin being conveyed in the conveyance path HK to the return opening 121 to output to the payout unit 4, and ejects the coin to the outside from the payout unit 4.

As explained above, according to the coin conveying device 10*b*, the conveying portion 80 that is structured with the holders 81 that can hold coins one by one and are endlessly connected is displaced in one direction along the rail portion 70 forming the predetermined conveyance path HK having the curved upper extension 73*a* (rising portion) that extends curving upward, and thereby conveys an input coin from below to above. Therefore, compared to a conventional manner of conveying coins with multiple belts that are arranged endlessly by being hooked to a pair of rollers under tension, an installation area of the coin processing apparatus 1 can be reduced, and thus, downsizing of the coin processing apparatus 1 is enabled.

In addition, the posture control member 101 controls the posture of a coin that is conveyed upward at the curved upper extension 73*a* of the third rail-forming member 73 by pushing the coin toward the third rail-forming member 73 (rail portion 70). Therefore, it is possible to prevent the coin from being derailed while passing the curved upper extension 73*a*, and thus suppress the occurrence of a coin jam during conveyance.

Furthermore, according to the coin conveying device 10*b* described above, when a coin is put into the conveying portion 80, the conveyance control unit 140 displaces the conveying portion 80 in the reverse direction for predetermined time, and then displaces the conveying portion 80 in one direction after the predetermined time passes. Therefore, a coin that is put in from the slot 72*d* can be accumulated in the second rail-forming member 72, and more coins can be accepted from the coin verification device 10*a*.

Moreover, according to the coin conveying device 10*b* described above, the conveyance control unit 140 displaces the conveying portion 80 such that a driving force for displacement in one direction is smaller than a driving force for displacement for the reverse direction. Therefore, if a problem occurs at the time of conveying a coin in one direction along the conveyance path HK and a coin jam is caused, by displacing the conveying portion 80 in the reverse direction by driving the conveyance driving motor 86 in the reverse direction, a larger power can be exerted for releasing the coin jam than that of the time when the coin gets clogged, and the coin jam can be resolved.

Furthermore, according to the coin conveying device 10*b* described above, the fourth rail-forming member 74 can swing in the vertical direction about the center axis of the first protrusion 75*a* and the second protrusion 75*b*. Therefore, when a coin jam occurs in the second rail-forming member 72 or the like, the coin causing the coin jam can be easily removed from the second rail-forming member 72 by swinging the fourth rail-forming member 74 upward.

As above, the exemplary embodiment of the disclosure has been explained, the disclosure is not limited thereto, and various modifications can be made.

The coin-verification control unit 60 and the conveyance control unit 140 are separately configured in the embodiment described above, but can be configured integrally with the coin-processor main-control unit 200 in the disclosure.

Although not specifically explained in the above embodiment, in the curved portion from the second left extension 74*a* to the rear extension 74*b* of the fourth rail-forming member 74 and in the curved portion from the rear extension 74*b* to the second right extension 74*c*, in the disclosure, the rail convex portion 74A is only required to be structured such that the protrusion height gradually decreases toward the outward direction. This enables to keep a coin passing therethrough to the outer side in the conveyance path HK.

Moreover, in the disclosure, a space to keep coins can be provided at a portion outside the curved portion from the first left extension 72*a* to the front extension 72*b* of the second rail-forming member 72 or the curved portion from the front extension 72*b* to the first right extension 72*c*.

According to the disclosure, a conveying portion that is structured with holders that can hold coins one by one and are connected endlessly is displaced in one direction along a rail portion forming a conveyance path to convey coins, and thereby conveys an input coin from below to above. Therefore, such an effect is obtained that compared to a conventional manner of conveying coins with multiple belts that are endlessly arranged by being hooked to a pair of rollers under tension, an installation area of a coin processing apparatus can be reduced, and thus, downsizing of the coin processing apparatus is enabled.

In addition, when an input coin is put into the conveying portion, a control unit causes the conveying portion to displace in a reverse direction opposite to one direction for predetermined time, and thereafter causes the conveying portion to displace in one direction after the predetermined time has elapsed. Therefore, such an effect is obtained that the input coin can be accumulated, and more coins can be accepted.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A coin conveying device for a coin processing apparatus configured to store an input coin according to denomination, and dispense a coin stored therein in accordance with a payout instruction, the coin conveying device comprising:

a rail portion configured to form a conveyance path to convey a coin;

a conveying portion including holders connected endlessly, each holder being configured to hold one coin, the conveying portion being configured to convey the input coin from below to above by displacing the conveying portion in one direction along the rail portion; and a controller configured to, when the input coin is put in the conveying portion, displace the conveying portion in a reverse direction that is opposite to the one direction for a predetermined time, and displace the conveying portion in the one direction after the predetermined time has elapsed, wherein the controller is configured to displace the conveying portion such that a driving force for displacement in the one direction is smaller than a driving force for displacement in the reverse direction.

2. The coin conveying device according to claim 1, wherein the conveyance path includes a rising portion that extends in a state curved upward, the coin conveying device further comprising a posture control member configured to push a coin being conveyed upward by the conveying portion at the rising portion against the rail portion to control a posture of the coin.

3. The coin conveying device according to claim 1, wherein the holder is configured to be displaced along the rail portion in a manner that a rail convex portion formed in the rail portion enters a holder concave portion formed in the holder.

4. The coin conveying device according to claim 1, wherein the conveyance path includes a falling portion that extends in a state curved downward, the coin conveying device further comprising a passage control member configured to: allow a coin being conveyed downward by the conveying portion to pass through the falling portion when the conveying portion is displaced in the one direction; and separate a coin being conveyed by the conveying portion from the holder to prevent the coin from passing through the falling portion when the conveying portion is displaced in the reverse direction.

5. A coin conveying device for a coin processing apparatus configured to store an input coin according to denomination, and dispense a coin stored therein in accordance with a payout instruction, the coin conveying device comprising:

a rail portion configured to form a conveyance path to convey a coin;

a conveying portion including holders connected endlessly, each holder being configured to hold one coin, the conveying portion being configured to convey the input coin from below to above by displacing the conveying portion in one direction along the rail portion; and a controller configured to, when the input coin is put in the conveying portion, displace the conveying portion in a reverse direction that is opposite to the one direction for a predetermined time, and displace the conveying portion in the one direction after the predetermined time has elapsed, wherein the holder is configured to be displaced along the rail portion in a manner that a rail convex portion formed in the rail portion enters a holder concave portion formed in the holder.

6. A coin conveying device for a coin processing apparatus configured to store an input coin according to denomination, and dispense a coin stored therein in accordance with a payout instruction, the coin conveying device comprising:

a rail portion configured to form a conveyance path to convey a coin;

a conveying portion including holders connected endlessly, each holder being configured to hold one coin, the conveying portion being configured to convey the input coin from below to above by displacing the conveying portion in one direction along the rail portion; and a controller configured to, when the input coin is put in the conveying portion, displace the conveying portion in a reverse direction that is opposite to the one direction for a predetermined time, and displace the conveying portion in the one direction after the predetermined time has elapsed, wherein the conveyance path includes a falling portion that extends in a state curved downward, the coin conveying device further comprising a passage control member configured to: allow a coin being conveyed downward by the conveying portion to pass through the falling portion when the conveying portion is displaced in the one direction; and separate a coin being conveyed by the conveying portion from the holder to prevent the coin from passing through the falling portion when the conveying portion is displaced in the reverse direction.

* * * * *